US010998675B2

(12) United States Patent
Lynch et al.

(10) Patent No.: US 10,998,675 B2
(45) **Date of Patent: *May 4, 2021**

(54) ELECTRICAL CONNECTOR

(71) Applicant: Interplex Industries, Inc., East Providence, RI (US)

(72) Inventors: Joseph Lynch, East Northpoint, NY (US); Richard Schneider, Livonia, MI (US)

(73) Assignee: Interplex Industries, Inc., East Providence, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/931,195

(22) Filed: May 13, 2020

(65) Prior Publication Data

US 2020/0274294 A1 Aug. 27, 2020

Related U.S. Application Data

(63) Continuation-in-part of application No. 16/324,642, filed as application No. PCT/US2017/047800 on Aug. 21, 2017, now Pat. No. 10,763,607.

(60) Provisional application No. 62/871,282, filed on Jul. 8, 2019, provisional application No. 62/377,859, filed on Aug. 22, 2016.

(51) Int. Cl.

| | |
|---|---|
| ***H01R 13/631*** | (2006.01) |
| ***H01R 13/405*** | (2006.01) |
| ***H01R 12/58*** | (2011.01) |
| ***H01R 13/504*** | (2006.01) |

(52) U.S. Cl.

CPC ..... *H01R 13/6315* (2013.01); *H01R 12/585* (2013.01); *H01R 13/405* (2013.01); *H01R 13/504* (2013.01)

(58) Field of Classification Search

CPC .. H01R 13/6315; H01R 13/112; H01R 12/73; H01R 12/58; H01R 12/91

See application file for complete search history.

(56) References Cited

U.S. PATENT DOCUMENTS

| | | | | |
|---|---|---|---|---|
| 5,556,286 | A | 9/1996 | Ikesugi et al. | |
| 10,763,607 | B2 * | 9/2020 | Schneider | H01R 43/26 |

* cited by examiner

*Primary Examiner* — Jean F Duverne
(74) *Attorney, Agent, or Firm* — Katterle Nupp LLC; Paul Katterle; Robert Nupp

(57) ABSTRACT

A connector for connection to a substrate for mounting electronic devices. The connector includes a plurality of coupling contacts pivotably disposed within a housing. Each coupling contact is generally H-shaped and defines opposing first and second spaces. The connector also includes one or more mounting contacts partially disposed within the housing. Each mounting contact has a fastening structure joined to a bar section. The fastening structure is adapted for securement to the substrate and the bar section is disposed in a second space of at least one of the coupling contacts.

20 Claims, 19 Drawing Sheets

ELECTRICAL CONNECTOR

CROSS-REFERENCE TO RELATED APPLICATION(S)

This application claims the benefit of U.S. Provisional Patent Application No. 62/871,282, filed on 8 Jul. 2019, and is a continuation-in-part of U.S. patent application Ser. No. 16/324,642 filed on 11 Feb. 2019, which is a U.S. National Stage filing under 35 U.S.C. § 371 of International Application No.: PCT/US2017/047800, filed on 21 Aug. 2017, which claims the benefit under 35 U.S.C. § 119(e) of U.S. Provisional Patent Application No. 62/377,859, filed on 22 Aug. 22, 2016, the contents of all of the foregoing applications being incorporated by reference herein in their entirety.

TECHNICAL FIELD

The present disclosure relates to an electrical connector for connecting electronic and/or electrical parts that may be misaligned.

BACKGROUND

In an electronic system it is necessary to establish electrical connections between constituent parts of the system. Often, these parts are relatively rigid and have fixed locations where the parts are to be connected together. For example, the parts that are to be connected together may be printed circuit boards (PCBs) and the connection locations may be plated through-holes in the PCBs. While each PCB may be produced in compliance with strict tolerances, the connection locations between the PCBs may nonetheless become misaligned due to tolerance stacking or other reasons.

A misalignment between the connection locations of parts can cause mating problems when the parts are connected together (or attempted to be connected together). For example, as set forth above, one or both of the parts may be a PCB with plated through-holes as connection points. In such a situation, a connector is typically secured to the through-holes using soldering or press-fit connections. Such connections, which are rigid and relatively fragile, can be physically damaged by errant forces that are produced when the misaligned parts are brought together. Even if the parts are not damaged, the electrical connections may not be as robust as they should be, due to the misalignment.

Based on the foregoing, it would be desirable to provide an electrical connector for electrically connecting parts, wherein the connector accommodates misalignment between the parts.

SUMMARY

A connector is disclosed for connection to a substrate for mounting electronic devices. The substrate may have one or more holes formed therein. The connector includes a plurality of monolithic metal contact plates held by a housing so as to be pivotably movable. Each of the contact plates has opposing planar surfaces and includes a pair of elements having opposing first and second end portions, respectively. The elements are joined together, intermediate the first and second end portions, with the first end portions being separated by a first space and the second end portions being separated by a second space. The coupling contacts are aligned and arranged serially in the housing with the planar surfaces of the coupling contacts being disposed parallel to each other. At least one mounting contact extends into the housing and has a bar section with opposing first and second edge portions. The bar section is disposed in the second space of at least one of the contact plates such that the first edge portion is disposed toward where the elements are joined together. The mounting contact further has a fastening structure joined to and extending from the second edge portion of the bar section. The fastening structure is adapted for insertion into one of the holes of the substrate.

Also disclosed is a method of forming a plurality of connectors. The method includes providing one or more first strips of metal and providing one or more second strips of metal. The one or more first strips of metal is stamped to form a plurality of separate contact plates strips, each of which includes interconnected nascent contact plates. Each of the nascent contact plates includes a pair of elements having opposing first and second end portions, respectively. The elements are joined together, intermediate the first and second end portions, with the first end portions being separated by a first space and the second end portions being separated by a second space. Each of the contact plate strips includes a header ribbon to which the first end portions of the nascent contact plates are joined. The one or more second strips of metal is stamped to form a plurality of separate housing strips, each of which includes a plurality of housing sections joined to a header ribbon. The contact plate strips are manipulated to form a stack of the contact plate strips, each of which includes a plurality of stacks of the nascent contact plates. The housing strips are manipulated to have one of the housing strips overlay another one of the housing strips to form a combination of the housing strips that comprises a plurality of interconnected nascent housings. Each of the nascent housings includes a pair of adjacent housing sections. A first one of the stacks of the nascent contact plates is inserted into a first one of the nascent housings. The housing sections of the first one of the nascent housings are welded together. The first one of the nascent housings is separated from the combination of the housing strips, and the first one of the stacks of the nascent contact plates is separated from the stack of the contact plate strips.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
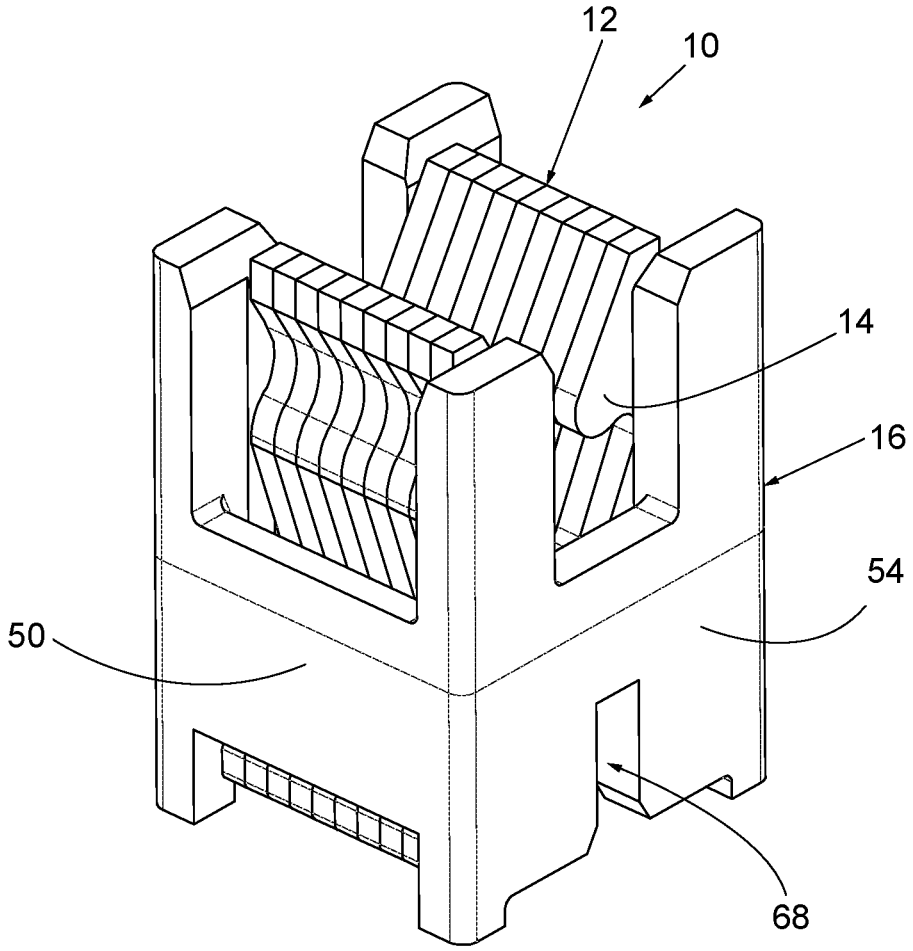
FIG. 1 shows a perspective view of a coupler of the disclosure.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Figure 2:
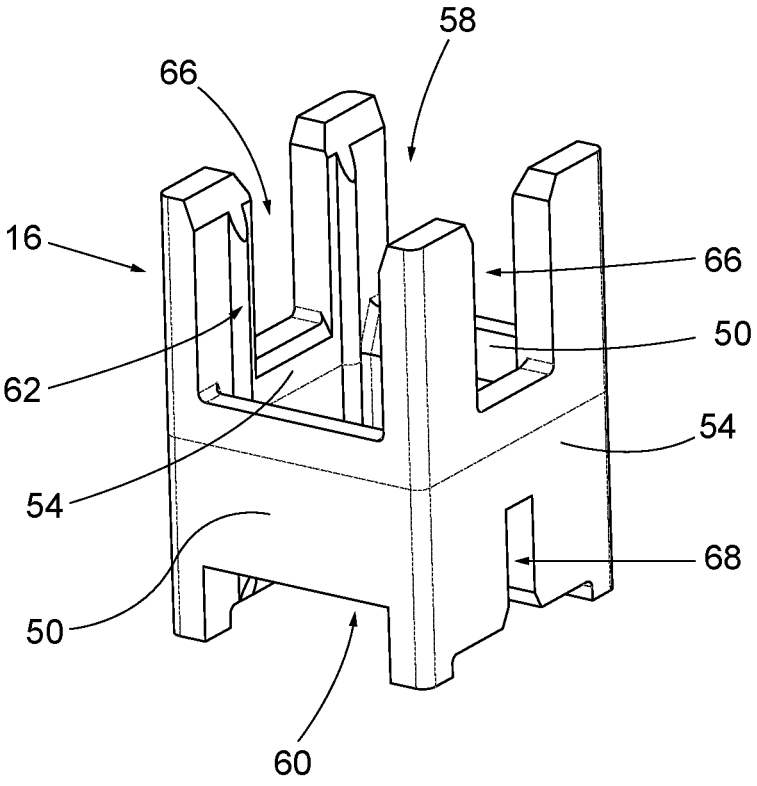
FIG. 2 shows a partially disassembled perspective view of the coupler with a stack of contact plates removed from a housing.
Figure 2:
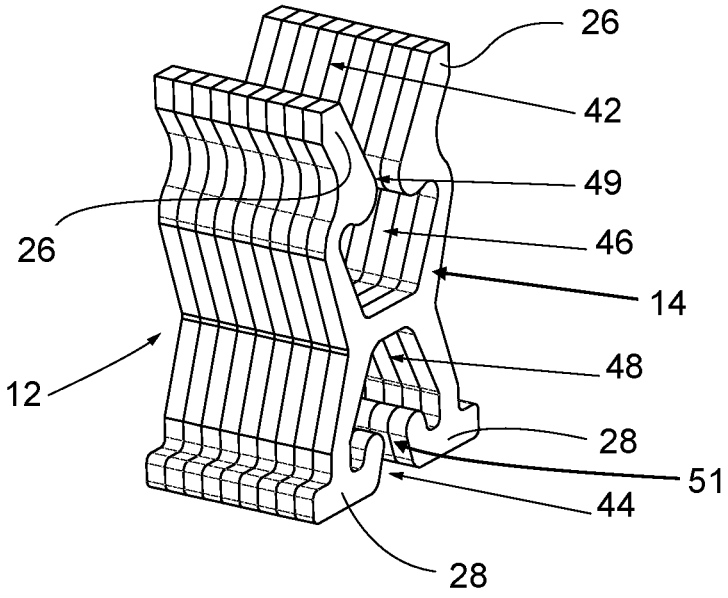
Figure 3:
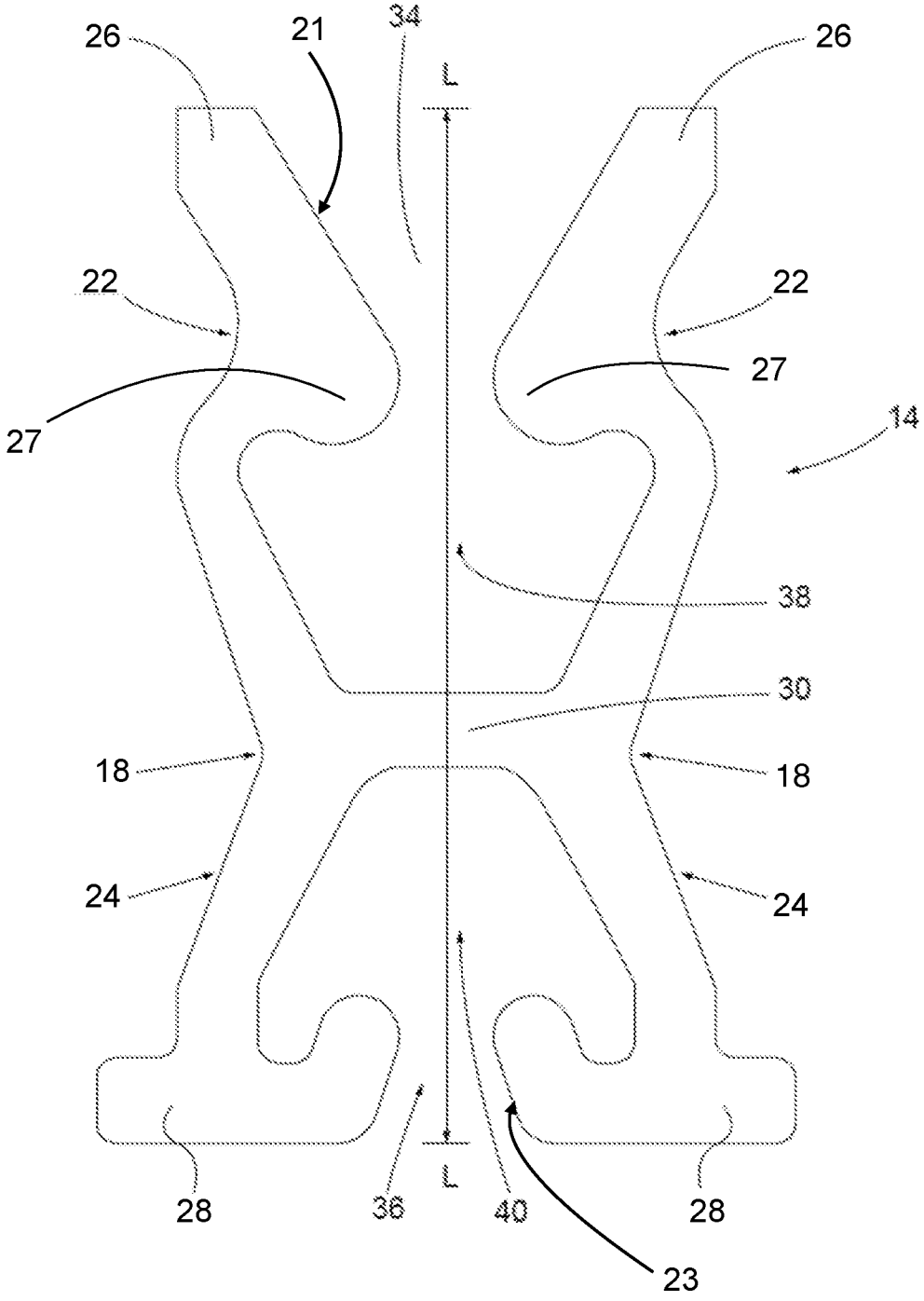
FIG. 3 shows a plan view of one of the contact plates.

Referring now to FIGS. 1 and 2, there is shown a coupler 10 constructed in accordance with this disclosure. The coupler 10 is comprised of a stack 12 of contact plates 14 disposed in a housing 16. Each of the contact plates 14 is a unitary or monolithic structure and is electrically conductive, being composed of a conductive metal, such as a tin plated copper alloy. As best shown in FIG. 3, each contact plate 14 includes a pair of irregular-shaped elements or legs 18. Each leg 18 includes an upper first portion 22 with a dog leg configuration and a lower second portion 24 with a generally L-shaped configuration. The first portion 22 includes a first end portion 26 that angles outwardly, relative to a longitudinal center axis L of the contact plate 14, which extends between the legs 18. The second portion 24 includes a second end portion 28 that extends laterally inward from an outer heel and then, towards the longitudinal center axis L, bends upward. The first end portions 26 have interior edges 21, respectively, and the second end portions 28 have interior edges 23, respectively. The legs 18 are joined together by a cross bar 30, intermediate the first and second end portions 26, 28. The cross bar 30 extends laterally between the legs 18 and helps give the contact plate 14 a general H-shape. The first end portions 26 define a first receiving space 34 therebetween, while the second end portions 28 define a second receiving space 36 therebetween. Each of the first receiving spaces 34 has a wide outer portion and a narrow inner portion, thereby giving the first receiving space a general V-shape. Each of the second receiving spaces 36 is also V-shaped; however, the first receiving space 34 is larger and its V-shape is more pronounced than the second receiving space 36. The first receiving space 34 adjoins a first inner space 38, while the second receiving space 34 adjoins a second inner space 40.

In one or more embodiments, each contact plate 14 may be at least partially covered with an electrical insulation coating. In other embodiments, the stack 12 may include a plurality of separate insulation plates or webs that are interleaved with the contact plates 14. In still other embodiments, the contact plates 14 may be separated by air gaps.

As shown, the contact plates 14 are arranged serially in the housing 16, with their planar surfaces being disposed parallel to each other and in close proximity. In some embodiments, the planar surfaces of the contact plates 14 may adjoin each other to form the stack 12. In other embodiments, the contact plates 14 may be separated by insulation coatings, webs or plates to form the stack 12. In still other embodiments, the contact plates 14 may be separated by spaces and/or portions of the housing. For example, a housing may be provided that includes a plurality of pockets within which the contact plates 14 are disposed, respectively. An example of such a housing is the housing 162 of the connector 154 described below.

The contact plates 14 are aligned with each other such that the first receiving spaces 34 form a first receiving groove 42 and the second receiving spaces 36 form a second receiving groove 44. Similarly, the first inner spaces 38 form a first inner groove or passage 46 and the second inner spaces form a second inner groove or passage 48. The narrowest portion of the first receiving groove 42 (which adjoins the first inner passage 46) is referred to as the contact zone 49. Similarly, the narrowest portion of the second receiving groove 44 (which adjoins the second inner passage 48) is referred to as a contact zone 51.

The first and second receiving grooves 42, 44 and the first and second inner passages 46, 48 extend in the stacking direction, which is normal to the planar surfaces of the contact plates 14. The number of contact plates 14 that are used is determined by the amount of electrical current the coupler 10 is designed to handle, with the current carrying capacity of the coupler 19 being increased by increasing the number of contact plates 14 used. Other factors that affect the current carrying capacity of the coupler 10 include the thickness of each contact plate 14, the type of plating used and the composition of the underlying metal structure.

The housing 16 is generally cuboid and is composed of an insulative material, such as plastic. The interior of the housing 16 is hollow and is sized to receive the stack 12 of contact plates 14 in a press fit operation, i.e., the interior is smaller in one or more dimensions than the stack 12. The housing 16 includes opposing first side walls 54, opposing second side walls 50 and opposing first and second open ends 58, 60. The second side walls 50 each have a rectangular major opening 62 disposed toward the first open end 58 and a rectangular minor opening 64 disposed toward the second open end 60. The first side walls 54 each have a rectangular major slot 66 disposed toward the first open end 58 and a rectangular minor slot 68 disposed toward the second open end 60.

The contact plates 14 are secured within the housing 16 in a press-fit operation in which the stack 12 as a whole is pressed into the housing 16 through the second open end 60. The resulting interference fit between the stack 12 and the housing 16 secures the contact plates 14 within the housing 16, but permits pivoting motion of the contact plates 14, as will be discussed more fully later.

The contact plates 14 are disposed within the housing 16 such that the first receiving spaces 34 of the contact plates 14 are aligned with the first open end 58 of the housing 16 and the second receiving spaces 36 of the contact plates 14 are aligned with the second open end 60 of the housing 16. In addition, the first receiving groove 42 of the stack 12 is aligned with the major slots 66 in the housing 16 and the second receiving groove 44 of the stack 12 is aligned with the minor slots 68 in the housing 16.

For purposes of facilitating description, components of the coupler 10 may be described with regard to X, Y, Z spatial coordinates, which are as follows: the X-axis extends through the first side walls 54 of the coupler 10, the Y-axis extends through the second side walls 50 of the coupler 10, and the Z-axis extends through the first and second open ends 58, 60 of the coupler 10.

The coupler 10 may be used in a variety of applications. In one application, the coupler 10 may be used to connect together two bus bars, with one bus bar being disposed in the first receiving groove 42 and the other bus bar being disposed in the second receiving groove 44. The major slots 66 and the minor slots 68 in the housing 16 permit the coupler 10 to receive the bus bars from different angles or directions. For example, both the first receiving groove 42 and the second receiving groove 44 may receive a bus bar that is oriented with its longitudinal axis parallel to the X-axis of the coupler 10 or parallel to the Y-axis of the coupler 10. In this manner, the two bus bars connected by the coupler 10 can be arranged parallel to each other in the direction of the X-axis or the Y-axis, or arranged perpendicular to each other.

In another application, the coupler 10 may be used to connect an edge connector of a PCB to a bus bar, an electrical/electronic device, or an edge connector of another PCB. The PCB edge connector may be disposed in the second receiving groove 44, while a bus bar, bar-like portion of the electrical/electronic device or an edge connector of the other PCB may be disposed in the first receiving groove 42.

Figure 4:
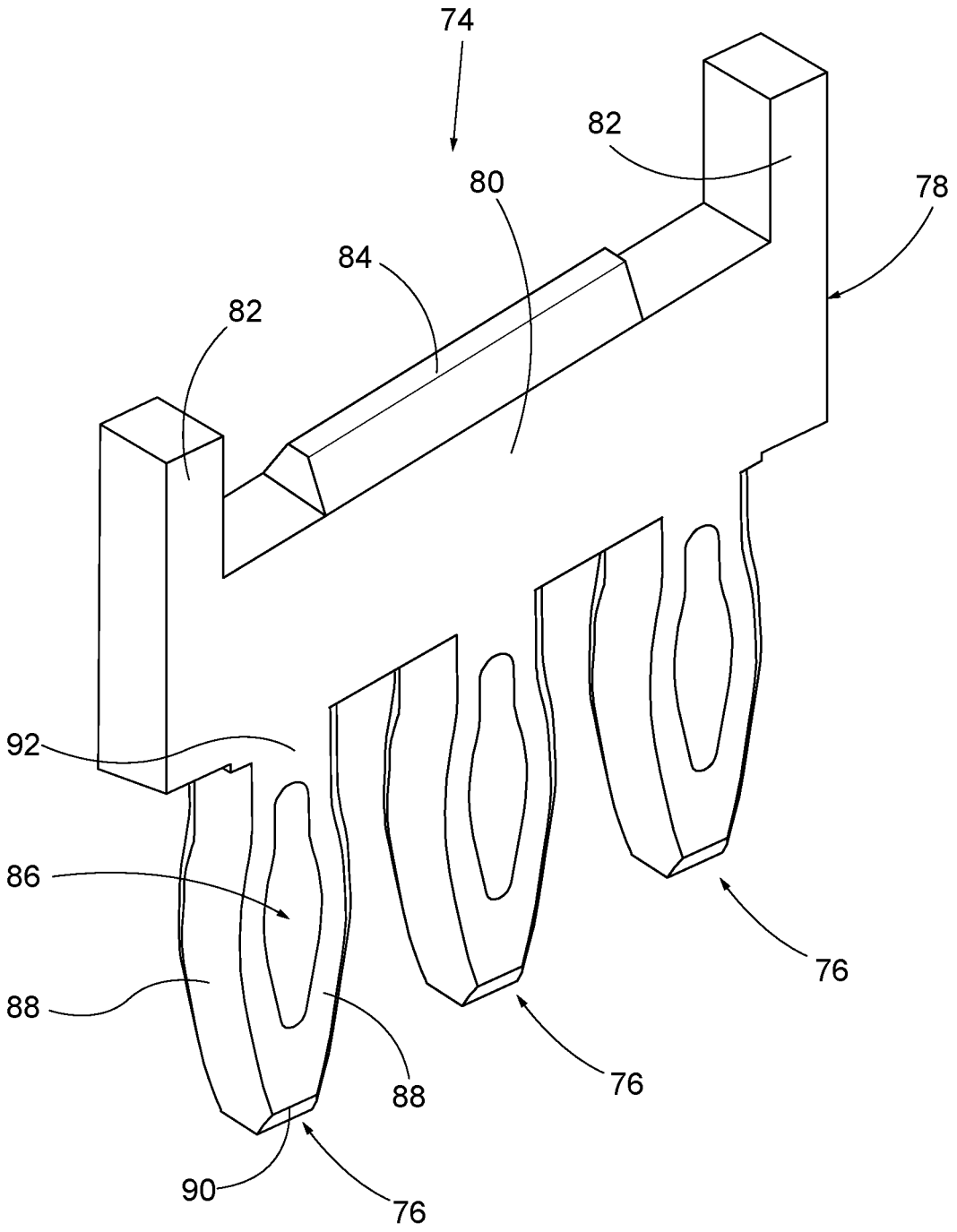
FIG. 4 shows a perspective view of a mounting contact for connection to the coupler.

In still another application, a mounting contact may be used to mount the coupler 10 to a substrate, such as a printed circuit board (PCB). Different embodiments of the mounting contact may be used, depending on the requirements of a particular application. One embodiment of the mounting contact (designated by the reference numeral 74) is shown in FIG. 4. The mounting contact 74 is a monolithic structure and is electrically conductive, being composed of a conductive metal, such as a tin plated copper alloy. The mounting contact 74 includes fastening structures 76 joined to a bar section 78. The bar section 78 is channel-shaped, having a center beam 80 joined between opposing, outwardly-extending arms 82. A blade 84 is joined to an upper portion of the beam 80 and has beveled surfaces that form an elongated edge. The blade 84 does not span the entire length of the beam 80 between the arms 82, but is, instead, separated by spaces from the arms 82, respectively. The blade 84 helps guide the beam 80 into the second receiving groove 44 and the second inner passage 48 of the stack 12 of contact plates 14.

The fastening structures 76 are joined to a lower portion of the beam 80 and extend outwardly therefrom, in a direction opposite the arms 82. Each fastening structure 76 may have a press-fit construction. More particularly, each fastening structure 76 may have an eye-of-the-needle (EON) type of press-fit construction. With this type of construction, each fastening structure 76 includes a center piercing 86 forming a pair of beams 88 that bow outwardly and are joined at an outer tip 90 and at an inner neck 92, which is joined to the beam 80. Each fastening structure 76 is adapted to be press-fit into a hole in a substrate, such as the plated hole in the PCB shown in FIG. 7. As the fastening structure 76 is being press-fit into the hole, the beams 80 initially deflect inward and then resiliently move outward to provide a normal force against the PCB hole, thereby providing a reliable physical and electrical connection.

The fastening structures used in the mounting contact 74 are not limited to having an EON-type of press fit construction. Instead, fastening structures having a different press-fit construction may be used, or the fastening structures may simply be elongated pins that are soldered into the holes of a PCB. In still another embodiment, the mounting contact 74 may have a single fastening structure that includes a mount joined to the beam 80, wherein the mount has a lower enlarged planar surface that may be soldered to a metal plate of an insulated metal substrate, such as a metal core printed circuit board.

Figure 5:
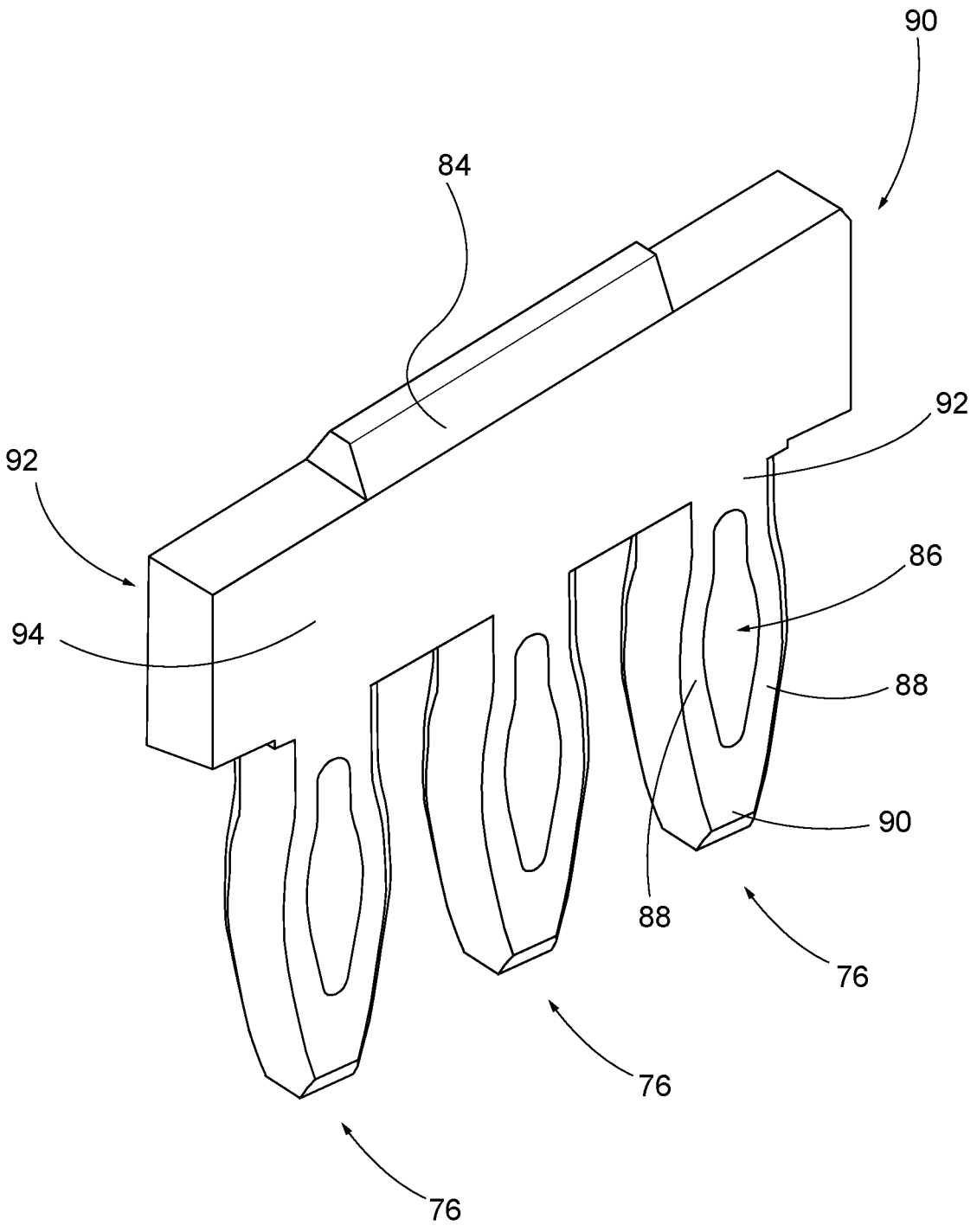
FIG. 5 shows a perspective view of a connecting contact for connection to a printed circuit board.

The coupler 10 may be used with a connecting contact to connect together two substrates, such as two PCBs, especially when higher currents (30 amps or greater) are involved. Referring now to FIG. 5, such a connecting contact 90 is shown. The connecting contact 90 has the same construction as the mounting contact 74, except the connecting contact 90 has a bar section 92 that is different from the bar section 78. More specifically, the bar section 92 only has a center beam 94, without any outwardly-extending arms. A blade 84 is joined to an upper portion of the beam 94. Fastening structures 76 are joined to a lower portion of the beam 94 and extend outwardly therefrom. As shown, each fastening structure 76 may have an EON type of press-fit construction.

Figure 6:
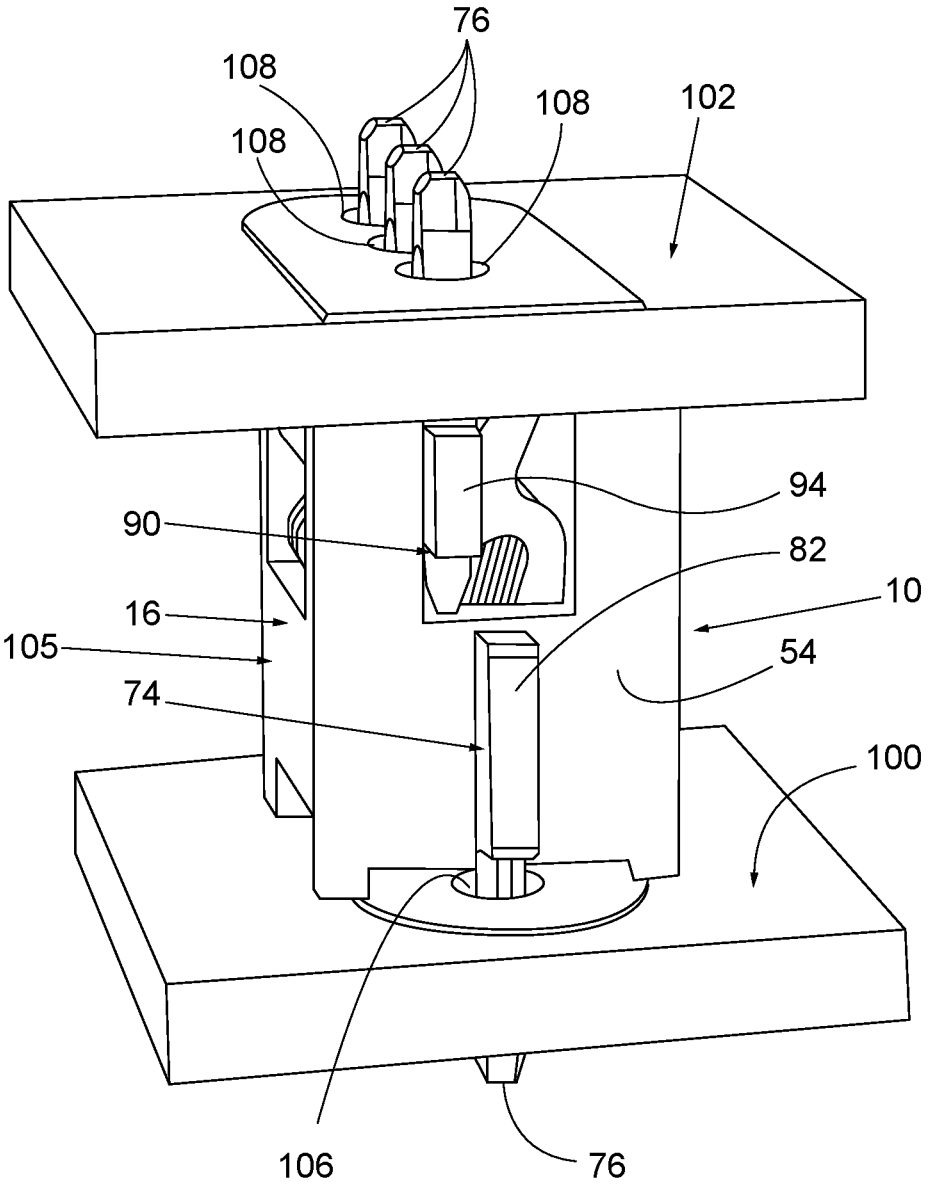
FIG. 6 shows a perspective view of a combination of the coupler, mounting contact, connecting contact and a pair of printed circuit boards.
Figure 7:
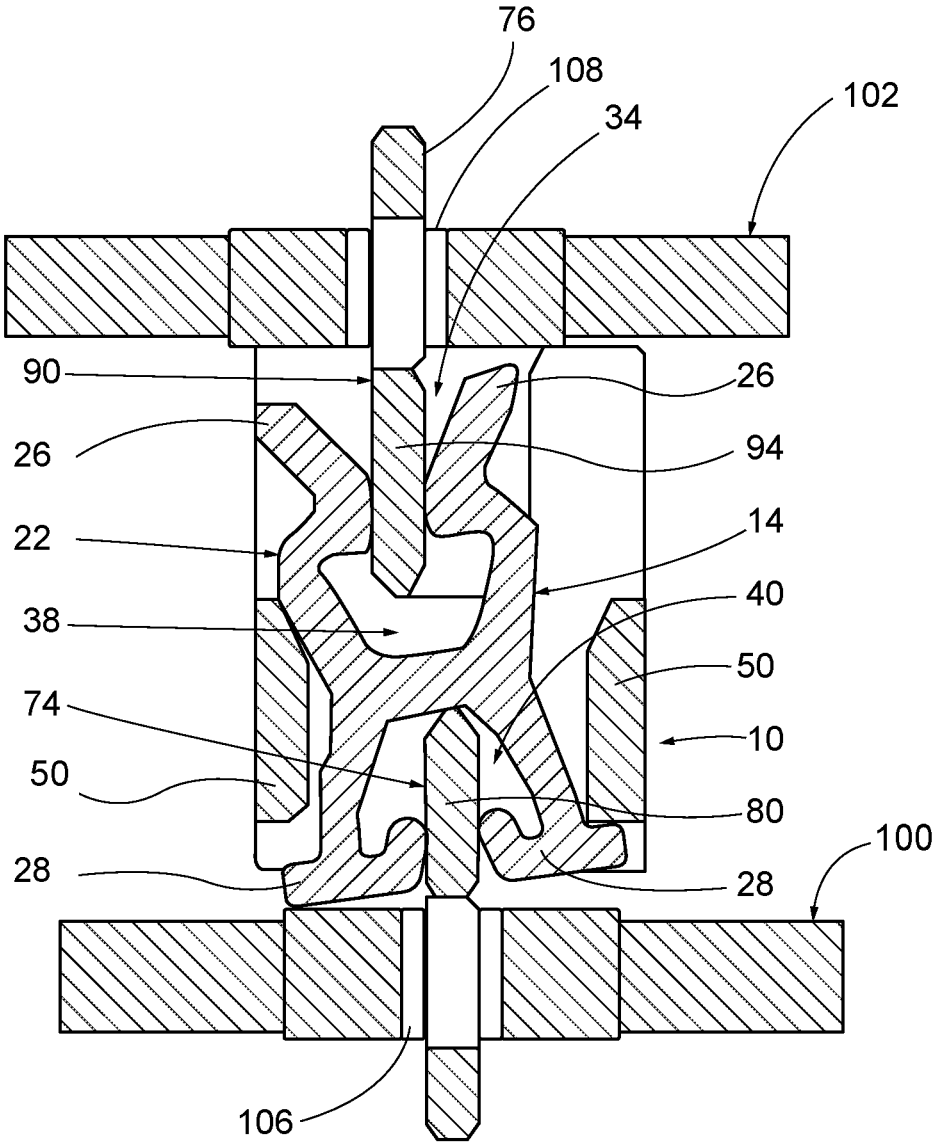
FIG. 7 shows a sectional view of the combination of FIG. 6.

Referring now to FIGS. 6 and 7, the coupler 10, the mounting contact 74 and the connecting contact 90 are shown connecting together two PCBs 100, 102, each of which has a plurality of plated through-holes that are electrically conductive. The process of connecting together the PCBs 100, 102 begins with the coupler 10 and the mounting contact 74 being mounted to the PCB 100, and the connecting contact 90 being mounted to the PCB 102. The PCB 102 is then connected to the PCB 100 by inserting the connecting contact 90 into the coupler 10.

The mounting contact 74 is secured to the coupler 10 by aligning the bar section 78 of the mounting contact 74 with the second receiving groove 44 of the coupler 10 and then applying a force to the mounting contact 74, while the coupler 10 is held still. The blade 84 guides the beam 80 into the second receiving groove 44 and the second inner passage 48 of the stack 12 of contact plates 14. The force is released when the beam 80 contacts inner edges of the first side walls 54 defining upper ends of the minor slots 68. At this point, the beam 80 extends through both the second inner passage 48 and the second receiving groove 44 and the arms 82 adjoin the first side walls 54 of the housing 16. In addition, the second end portions 28 of the contact plates 14 press against the beam 84, thereby electrically connecting the coupler 10 to the mounting contact 74. As will be discussed in more detail below, the combination of the coupler 10 and the mounting contact 74 forms a connector 105 that permits the PCB 100 to be connected to the PCB 102, even though the PCBs may be misaligned.

Next, the connector 105 is secured to the PCB 100. The fastening structures 76 are aligned with plated holes 106 in the PCB 100, respectively, and then a force is applied to the connector 105, such as against the outer ends of the arms 82. The fastening structures 76 deform as they enter the holes 106 and then resiliently spring back to secure the fastening structures 76 within the holes 106. The connector 105 is now physically and electrically connected to the PCB 100. It should be appreciated that with the housing 16 trapped between the arms 82 of the mounting contact, the coupler 10 is provided with additional stability relative to the PCB 100 in the direction of the X-axis.

The connecting contact 90 is mounted to the PCB 102 by aligning the fastening structures 76 with plated holes 108 in the PCB 102, respectively, and then applying a force, such as against outer end portions of the beam 94. The fastening structures 76 deform as they enter the holes 108 and then resiliently spring back to secure the fastening structures 76 within the holes 108, thereby physically and electrically connecting the connecting contact 90 to the PCB 102.

The PCB 102 is connected to the PCB 100 by inserting the beam 94 of the connecting contact 90 (secured the PCB 102) into the first receiving groove 42 of the connector 105 (secured to the PCB 100). Since the PCB 102 and the PCB 100 are rigid bodies and they are to be connected with a low Z-space therebetween, there may be some misalignment in the Y-direction between the beam 94 and the first receiving groove 42. To better illustrate the operation of the connector 105, the beam 94 is shown as being offset to the left (as viewed from FIG. 7) from the longitudinal center axes L of the contact plates 14. The connector 105, however, accommodates this misalignment. As the beam 94 moves into the first receiving groove 42, the blade 84 contacts the sloping interior edges 21 of the first end portions 26 of the contact plates 14, which causes the contact plates 14 to pivot about the beam 80 (the X-axis) in a counterclockwise direction (as viewed from FIG. 7) and guide the beam 94 into the contact zone 49. The major opening 62 in the second side wall 50 permits this pivoting by receiving the first end portions 26 of the legs 18 of the contact plates 14. The pivotal movement of the contact plates 14 is shown in FIG. 7 and is about eight and a quarter degrees. Even though the contact plates 14 have pivoted out of their normal position, they still maintain a good physical and electrical connection with the beam 94, thereby establishing a good physical and electrical connection between the PCB 102 and the PCB 100. As shown in FIG. 7, the beam 94 is pressed between the interior edges 21 of the first end portions 26 of the contact plates 14 in the contact zone 49.

It should be appreciated that in addition to accommodating misalignment in the Y-direction, the connector 105 also accommodates misalignment in the X-direction and the Z-direction, as well as angular or twist misalignment in any of the three directions. The alignment of the first receiving groove 42 with the major slots 66 permits the beam 94 to be offset in the X-direction vis-a-vis the first receiving groove 42 and still make a good physical and electrical connection with the contact plates 14. In the Z-direction, the beam 94 does not need to extend into the first inner passage 46 to the full extent possible to make a good physical and electrical connection.

Another advantage provided by the connector 105 is that it accommodates movement between parts that may occur after the parts have been connected. For example, the parts may move relative to each other due to environmental factors, such as temperature, vibration, impact or handling. The connector 105 permits this relative movement, while still maintaining a good electrical and physical connection between the parts.

In addition to being well suited to connect together two PCBs, the connector 105 is well suited to connect together other rigid electronic components. In particular, the attributes of the connector 105 make it especially well suited for connecting a bus bar to a PCB to supply power thereto. These attributes of the connector 105 include its small X-Y footprint, its ability to connect together misaligned rigid bodies and its ability to accommodate larger currents. Indeed, the current capacity of the connector 105 is scalable by changing the number of contact plates 14 used and/or changing the thickness, plating or structural composition of the contact plates 14. Current capacities of 30 amps or more are achievable. When used to connect a bus bar to a PCB, such as the PCB 100, an end or a portion of the bus bar is disposed within the first receiving groove 42 and the first inner passage 46 such that the enlarged planar surfaces of the bus bar engage the interior edges 21 of the first end portions 26 of the contact plates 14 in the contact zone 49. Multiple connectors 105 may be used to mount a bus bar to a PCB.

Figure 8:
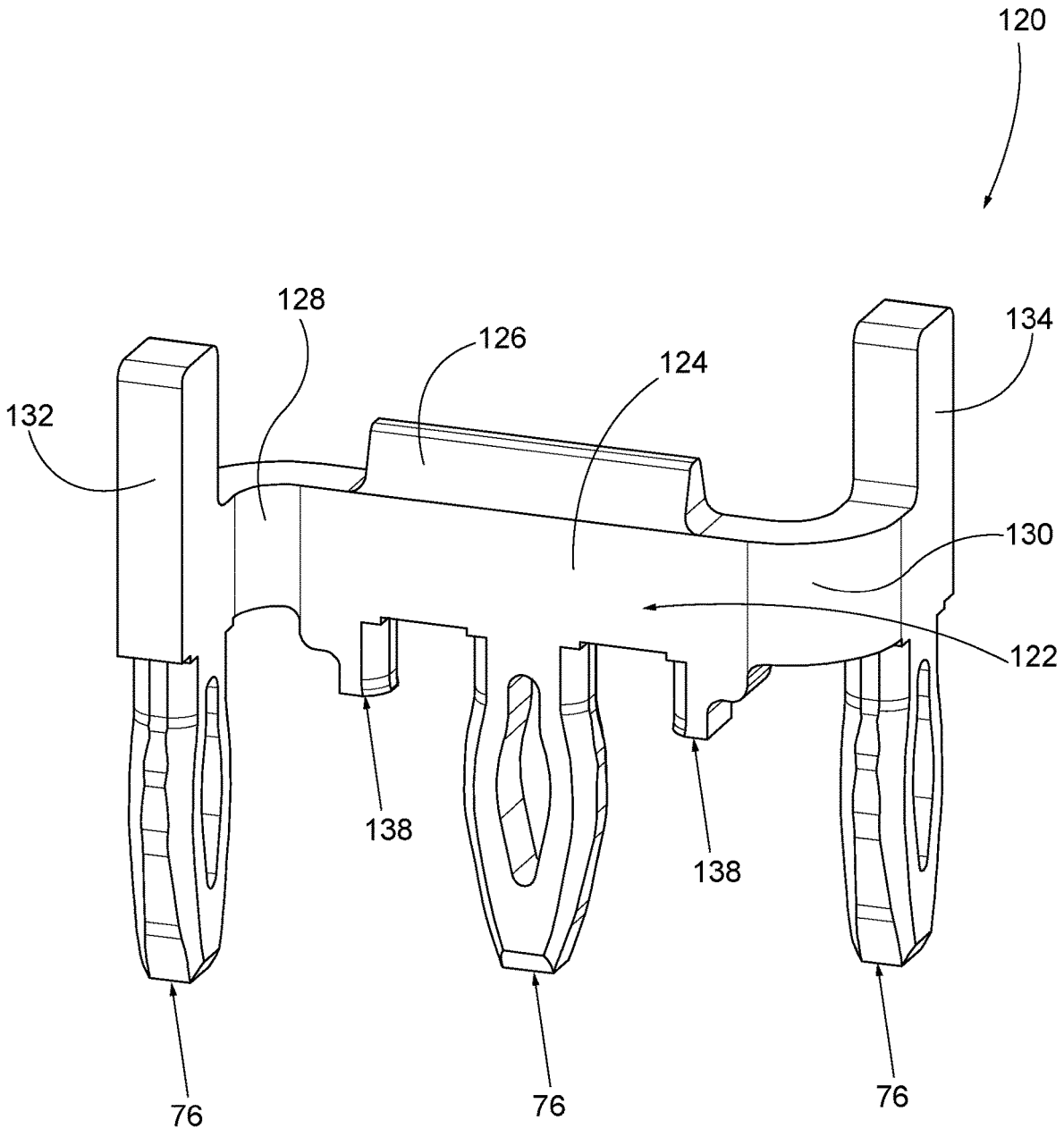
FIG. 8 shows a perspective of a frame contact for connection to the coupler.

Depending on a particular connection between a PCB and bus bar, the connector 105 may be modified to provide more stability against rotating or tipping relative to the PCB as a result of the forces that may be applied by the bus bar. One such modification may be to replace the mounting contact 74 with a different type of mounting contact. For example, the mounting contact 74 may be replaced with the mounting contact or frame contact 120, which is shown in FIG. 8. The frame contact 120 is a monolithic, generally Z-shaped structure and is electrically conductive, being composed of a conductive metal, such as a tin plated copper alloy. The frame contact 120 has a bar section 122 with fastening structures 76 extending outwardly therefrom. The bar section 122 includes a center beam 124 having opposing ends joined by bends 128 130 to arms 132, 134, respectively. The bends 128, 130 curve in opposing directions to give the frame contact 120 its Z-shape. A blade 126 is joined to an upper portion of the beam 124 and has beveled surfaces that form an elongated edge. The arms extend upwardly beyond the blade 126. Two of the fastening structures 76 are joined to lower portions of the arms 132, 134, respectively, and extend downwardly therefrom. A third (or center) fastening structure 76 is joined to a lower portion of the beam 124 and extends downwardly therefrom. A pair of supports 138 are also joined to the lower portion of the beam 124 and extend downwardly therefrom. The supports 138 bracket the center fastening structure 76.

It should be appreciated that the frame contact 120 may be modified to have a greater or lesser number of fastening structures 76 or to have a different configuration. For example, instead of the bends 128, 130 curving in opposing directions, the bends 128, 130 may curve in the same direction, which would give the frame contact 120 a general U-shape. Still another example would be having only one of the bends 128, 130 so that the frame contact 120 has a general L-shape.

Figure 9:
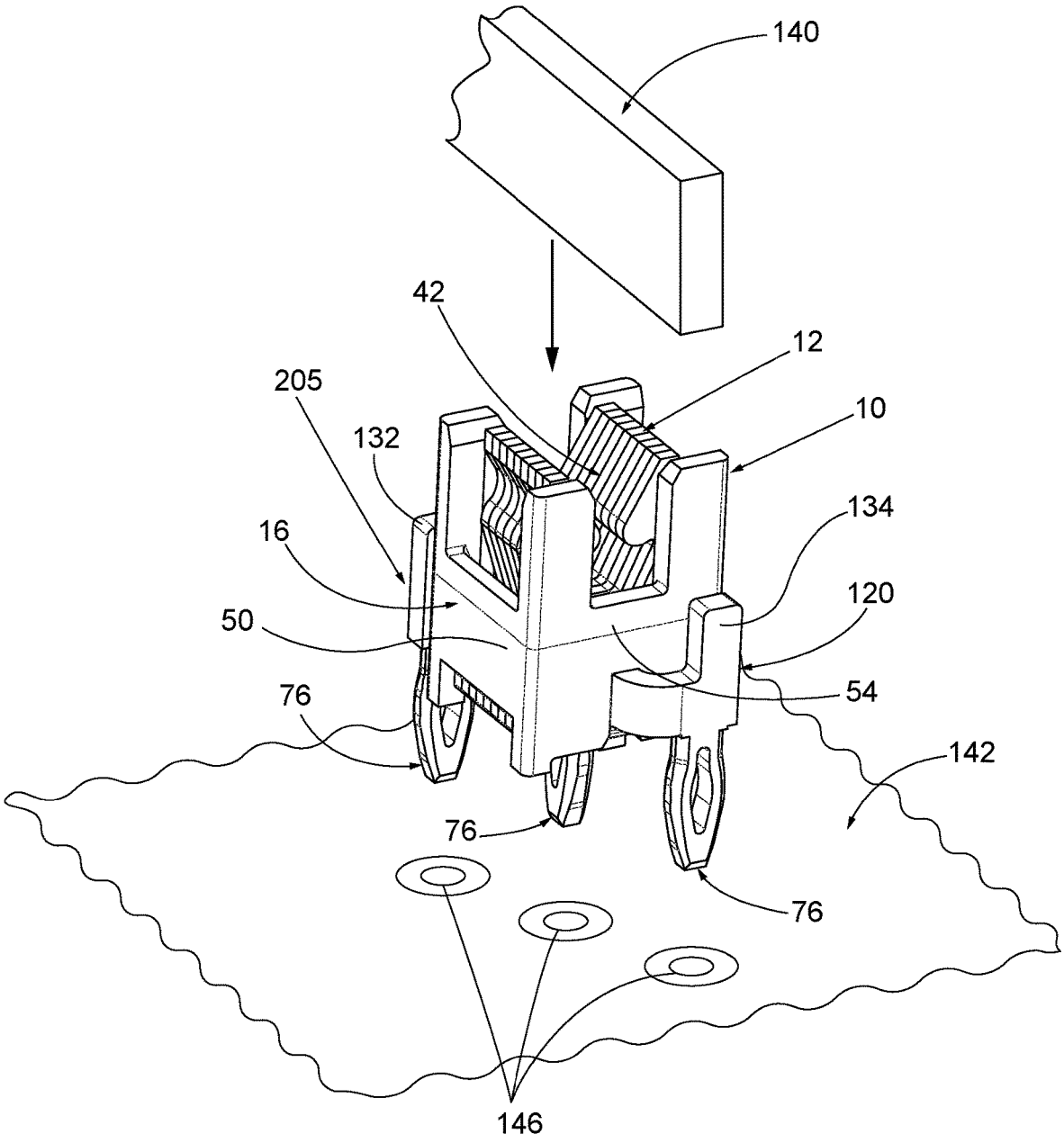
FIG. 9 shows a perspective view of the frame contact connected to the coupler disposed between a bus bar and a printed circuit board.

Referring now to FIG. 9, the frame contact 120 is shown mounted to the coupler 10 to form a connector 205, which will help connect a bus bar 140 to a PCB 142 to provide power thereto. Although not shown, multiple connectors 205 may be used to mount the bus bar 140 to the PCB 142. The frame contact 120 is mounted to the coupler 10 by inserting the beam 124 into the second receiving groove 44 and the second inner passage 48 of the coupler 10. With the beam 124 so positioned, the arms 132, 134 are disposed against the first side walls 54 of the coupler 10, respectively. However, the first arm 132 is positioned against the first side wall 54, toward the second side wall 50, while the second arm 134 is positioned against the first side wall 54, toward the second side wall 50.

In the connector 205, the fastening structures 76 are not arranged in the direction of the X-axis, parallel to the second receiving groove 44, as in the coupler 105. Instead, the fastening structures 76 are arranged diagonal to the X-axis. Moreover, the fastening structures 76 are not all positioned with their widths (beam to beam) extending in the direction of the X-axis, as in the coupler 105. Instead, the outer fastening structures 76 are positioned with their widths extending in the direction of the Y-axis, while the middle fastening structure 76 (joined to the beam 124) is positioned with its width extending in the direction of the X-axis. When the connector 205 is mounted to the PCB 142 by press-fitting the fastening structures 76 into the plated holes 146 of the PCB 142, the foregoing arrangement of the fastening structures 76 helps prevent the connector 205 from pivoting about the X-axis and otherwise moving due to torsional and other forces applied by the bus bar 140. In this regard, it should be noted that when the connector 205 is mounted to the PCB 142, the supports 138 of the frame contact 120 contact the surface of the PCB 142 and help provide additional support for and stability to the connector 205.

As shown in FIG. 9, the connector 205 may be used to mount a bus bar to a PCB so that the enlarged planar surfaces and the short edges of the bus bar are disposed perpendicular to the plane of the PCB, while the long edges of the bus bar are parallel to the plane of the PCB. In order to mount a bus bar to a PCB in orientations different than this, the connector 205 may be modified. For example, if it is desired to mount a bus bar to a PCB so that the enlarged planar surfaces of the bus bar are parallel to the plane of the PCB, the connector 205 may be modified to be mounted to the PCB so that both the longitudinal axes L of the contact plates and the first receiving groove 42 are parallel to the plane of the PCB, i.e., one of the second side walls 50 is disposed adjacent to the PCB. The modifications utilized to accomplish this change in mounting may include modifying the frame contact 120 to remove the blade 126 and join an elongated tab or bar to the end of the arm 132, wherein the bar extends rearwardly, with its planar surfaces disposed perpendicular to the arm 132. The bar is inserted into the second receiving groove 44 of the coupler 10 and the fastening structures 76 are press-fit into holes in the PCB.

Other modifications may be made to the frame contact 120 to mount the coupler 10 to a PCB in still other orientations. For example, the frame contact 120 may be modified to replace the blade 126 with an elongated tab or bar, which would be inserted into the second receiving groove 44 of the coupler 10. This modification of the frame contact 120 would permit the coupler 10 to be mounted to a PCB such that the one of the first side walls 54 is disposed adjacent to the PCB.

Figure 10:
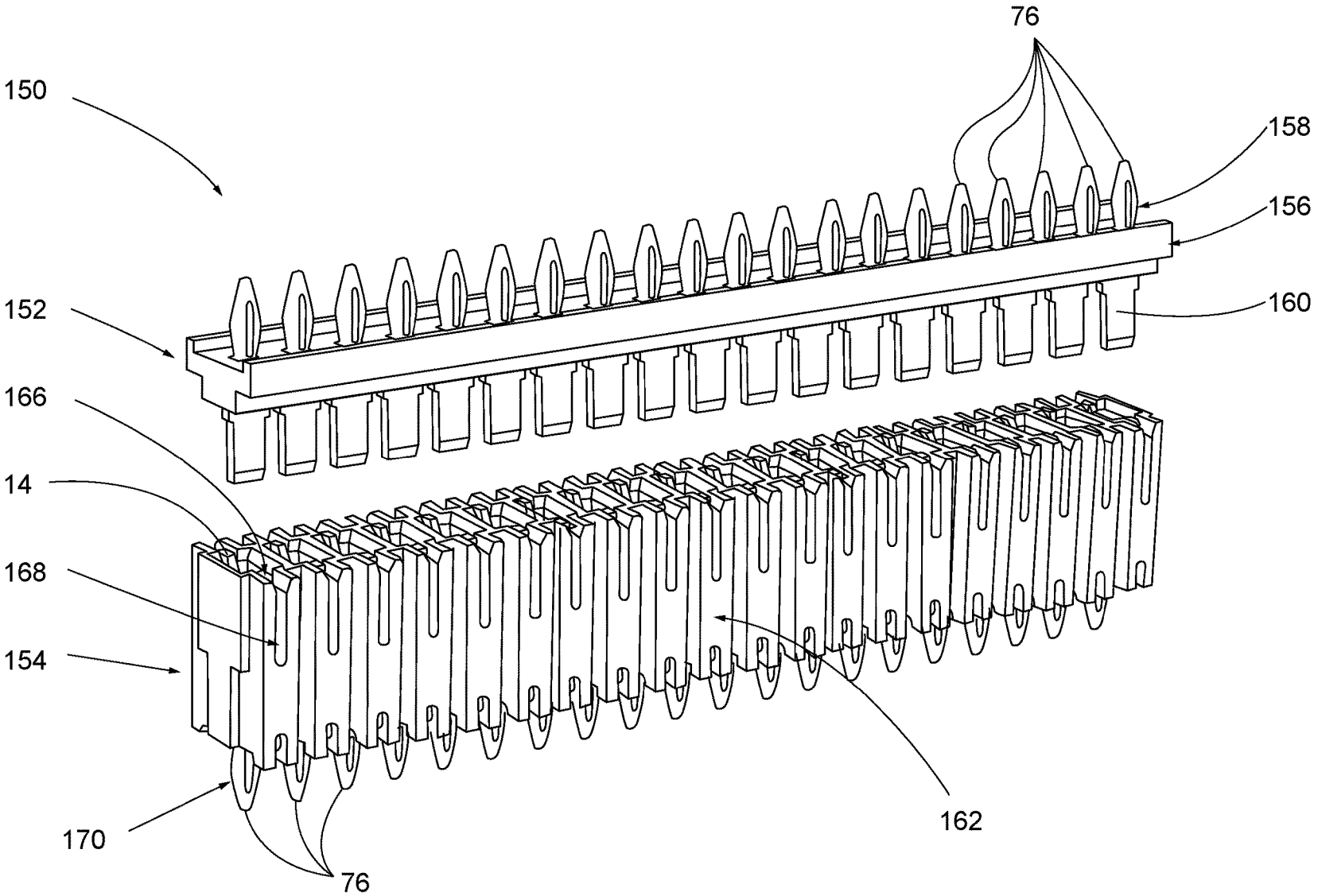
FIG. 10 shows a perspective view of a pair of connectors.

Referring now to FIG. 10, there is shown a connector assembly 150 for connecting together first and second PCBs to permit low current signals to be transmitted therebetween. The connector assembly 150 includes a connector 152 and a connector 154.

The connector 152 includes a plurality of signal contacts 158 secured to a housing 156 composed of insulating material, such as plastic. Each of the signal contacts 158 is a monolithic structure and is electrically conductive, being composed of a conductive metal, such as a tin plated copper alloy. Each signal contact 158 includes a fastening structure 76 joined at its neck to a spade 160 with a beveled end. The fastening structures 76 and the spades 160 extend outwardly from the housing 156 in opposing directions. The fastening structures 76 are adapted to be press-fit into plated holes in a first PCB.

The connector 154 includes a housing 162 composed of insulating material, such as plastic. The housing 162 has a plurality of pockets 166 arranged serially along its length. The pockets 166 have open top and bottom ends and are separated from each other by interior walls. A series of side slots 168 are formed in the front and rear sides of the housing 162, with each pocket 166 having a pair of opposing slots 168. A single contact plate 14 is press-fit into each pocket 166 such that the first portions 22 of the legs 18 are aligned with the opposing slots 168, respectively. With the contact plate 14 so positioned, the first receiving space 34 of the contact plate 14 is aligned with the open top end of the pocket 166 and the second receiving space 36 of the contact plate 14 is aligned with the open bottom end of the pocket 166. Each contact plate 14 is pivotably movable within its pocket 160.

A plurality of signal contacts 170 are mounted to the housing 162 and extend downwardly therefrom. Each of the signal contacts 170 is a monolithic structure and is electrically conductive, being composed of a conductive metal, such as a tin plated copper alloy. Each signal contact 170 includes a fastening structure 76 joined at its neck to a tab (not shown). The fastening structures 76 are adapted to be press-fit into plated holes in a second PCB. The tabs of the fastening structures 76 are inserted through the open bottom ends into the pockets 166, respectively, so as to engage the contact plates 14, respectively. More specifically, within each pocket 166, the tab of the fastening structure 76 is received within the second receiving space 36 and the second inner space 40 of the contact plate 14, with the tab being pressed between the inner surfaces of the second end portions 28 of the contact plate 14.

It should be appreciated that the fastening structures 76 used in the connectors 152, 154 are not limited to having an EON-type of press fit construction. Instead, fastening structures having a different press-fit construction may be used, or the fastening structures may simply be elongated pins that are soldered into the holes of a PCB.

After the connectors 152, 154 are mounted to the first and second PCBs, the first and second PCBs are connected together by inserting the spades 160 of the connector 152 (secured to the first PCB) into the first receiving spaces 34 of the contact plates 14 of the connector 154 (secured to the PCB 100). If the first and second PCBs are misaligned in the direction of the front and rear sides of the housing 162, the spades 160 will contact the sloping interior edges 21 of the first end portions 26 of the contact plates 14, thereby pivoting the contact plates 14 about the tabs of the signal contacts 170, respectively. The side slots 168 in the housing 162 permit this pivoting.

Figure 11:
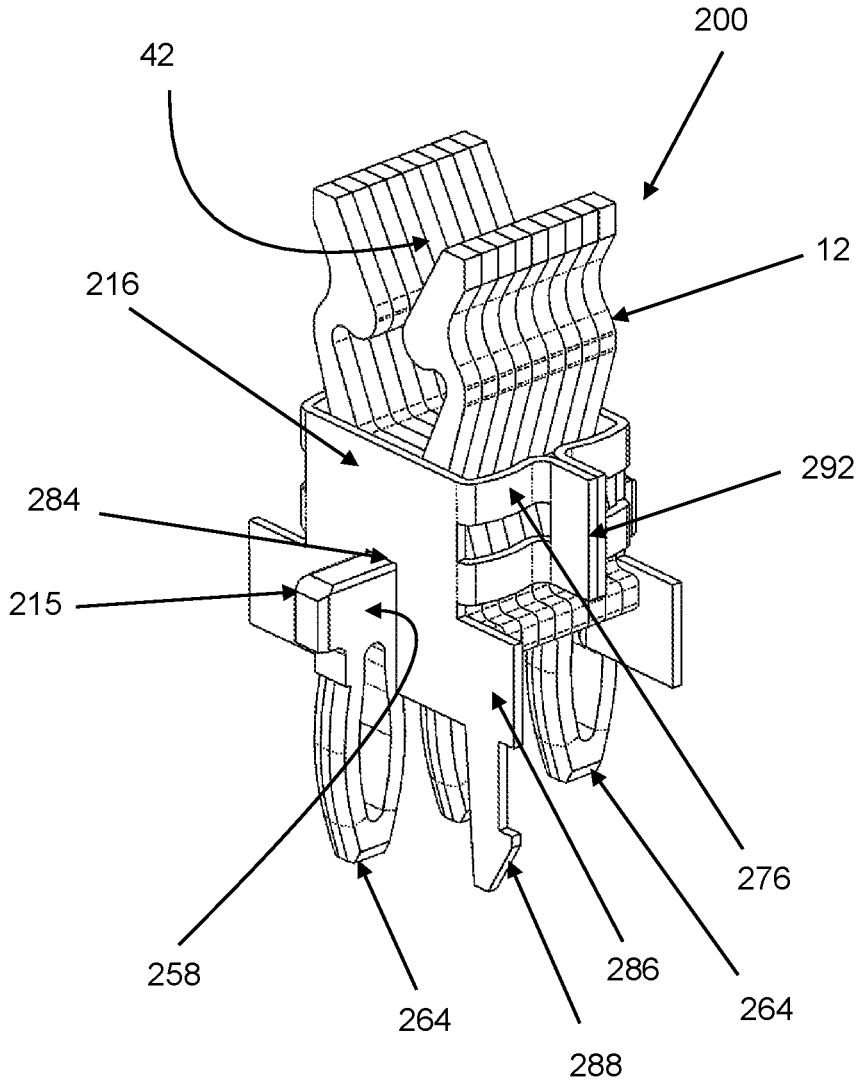
FIG. 11 shows a side perspective view of a connector constructed in accordance with a second embodiment of the disclosure.

Referring now to FIG. 11, there is shown a connector 200 that is constructed in accordance with another embodiment of the present disclosure. The connector 200 includes the stack 12 of the contact plates 14. The stack 12 is connected to a mounting contact 215 and is at least partially disposed in a housing 216.

Figure 13:
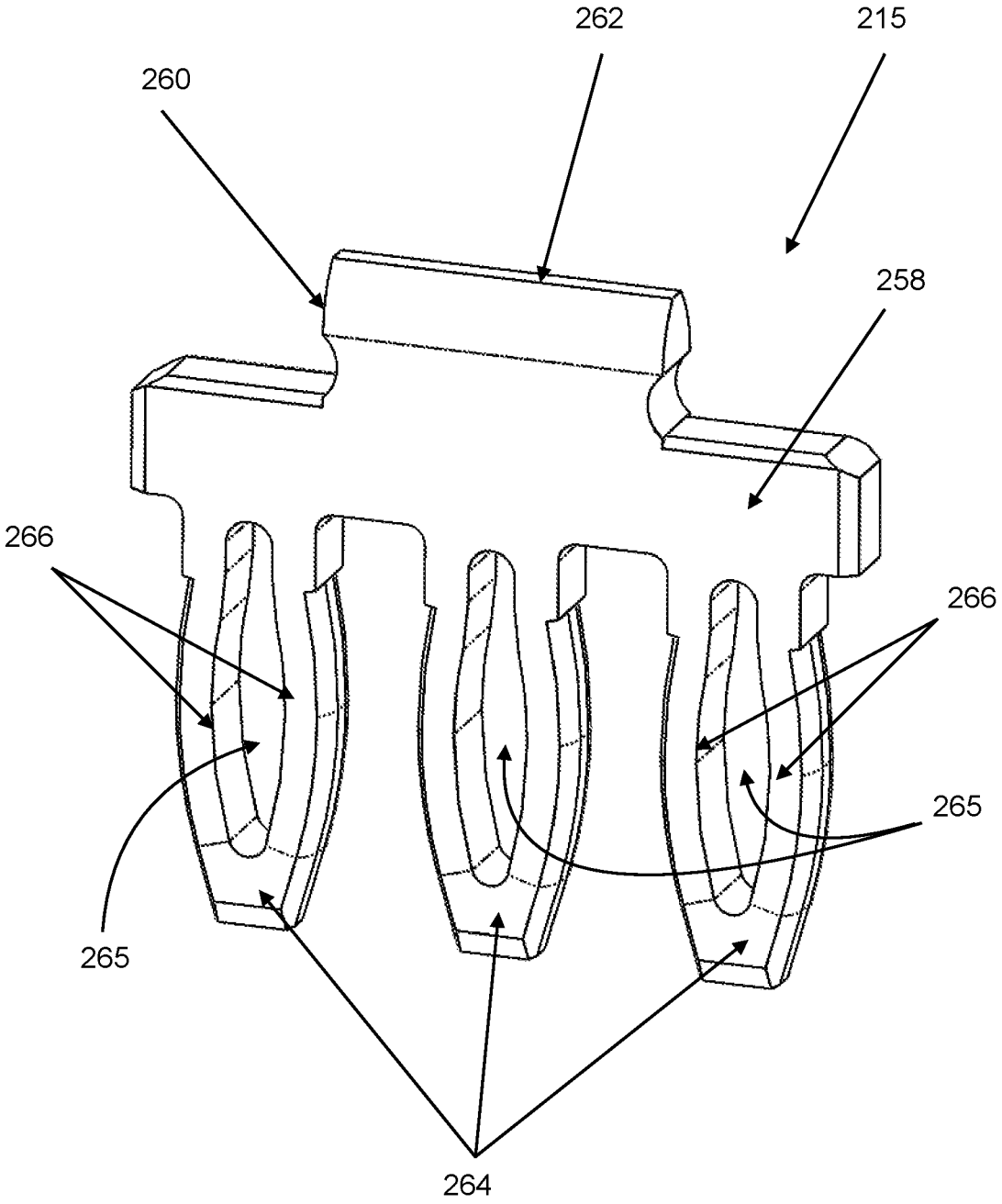
FIG. 13 shows a perspective view of a mounting contact of the connector of FIGS. 11 and 12.

Referring now to FIG. 13, the mounting contact 215 is a monolithic structure and is electrically conductive, being composed of a conductive metal, such as a tin plated copper alloy. The mounting contact 215 includes a horizontally-extending bar 258, with opposing ends. A blade structure 260 is joined to an upper portion of the bar 258 and has beveled upper surfaces that form an elongated edge 262. The blade structure 260 does not span the entire length of the bar 258, but is, instead, centered between opposing ends of the bar 258. The blade structure 260 helps guide the bar 258 into the second receiving groove 44 and the second inner passage 48 of the stack 12 of contact plates 14.

Fastening structures 264 are joined to a lower portion of the bar 258 and extend outwardly therefrom, in a direction opposite the blade structure 260. While three fastening structures 264 are shown, more than three or less than three may be provided. Each fastening structure 264 may have a press-fit construction. More particularly, each fastening structure 264 may have an eye-of-the-needle (EON) type of press-fit construction. With this type of construction, each fastening structure 264 includes a center piercing or hole 265 forming a pair of beams 266 that bow outwardly and are joined at an outer tip and at a base, which is joined to the bar 258. Each fastening structure 264 is adapted to be press-fit into a hole in a substrate, such as a plated hole in a PCB. As the fastening structure 264 is being press-fit into the hole, the beams 266 initially deflect inward and then resiliently move outward to provide a normal force against the PCB hole, thereby providing a reliable physical and electrical connection.

The fastening structures 264 used in the mounting contact 215 are not limited to having an EON-type of press fit construction. Instead, fastening structures 264 having a different press-fit construction may be used, or the fastening structures 264 may simply be elongated pins that are soldered into the holes of a PCB. In still another embodiment, the mounting contact 215 may have a single fastening structure that includes a mount joined to the bar 258, wherein the mount has a lower enlarged planar surface that may be soldered to a metal plate of an insulated metal substrate, such as a metal core printed circuit board.

Figure 12:
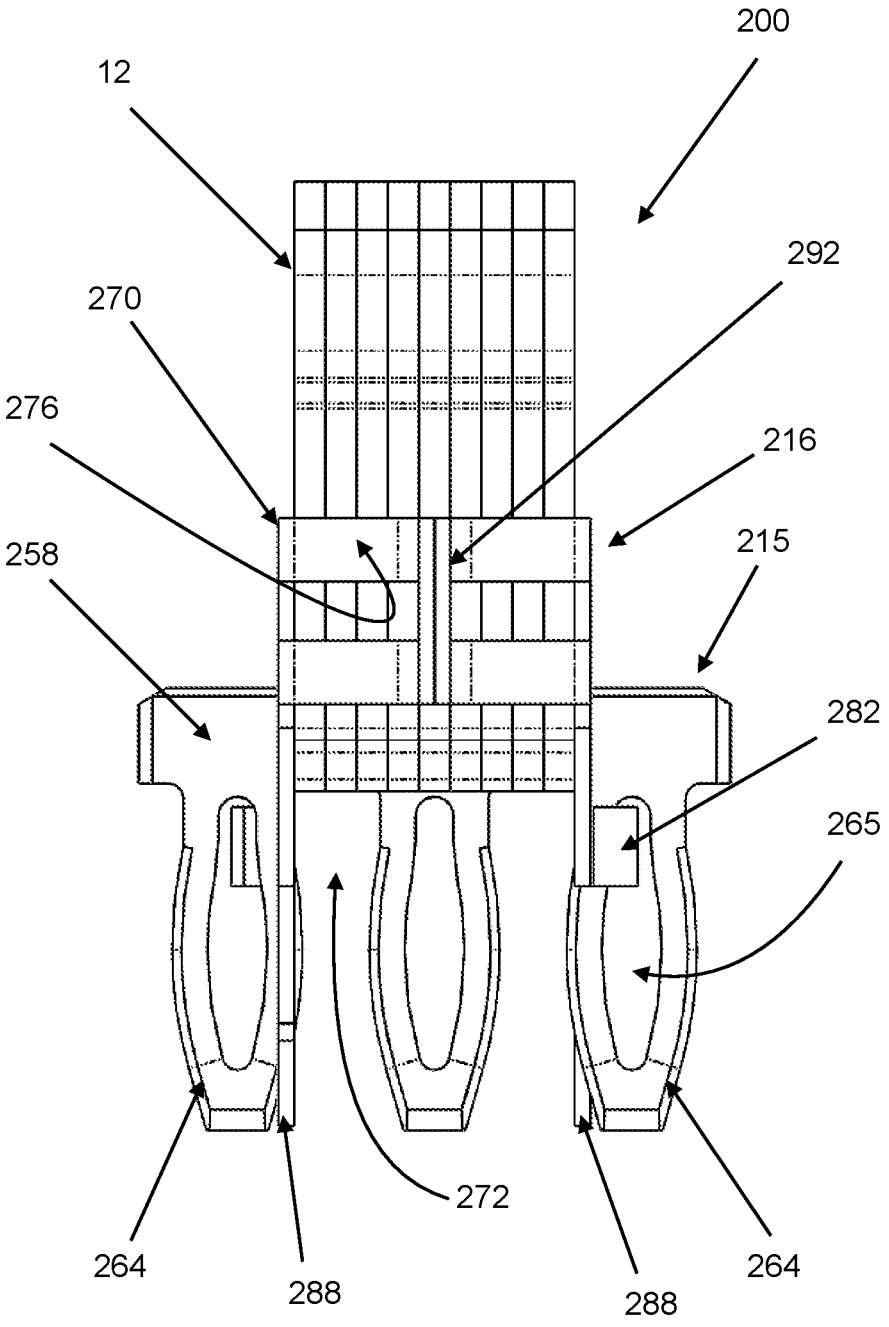
FIG. 12 shows a side view of the connector of FIG. 11.
Figure 14:
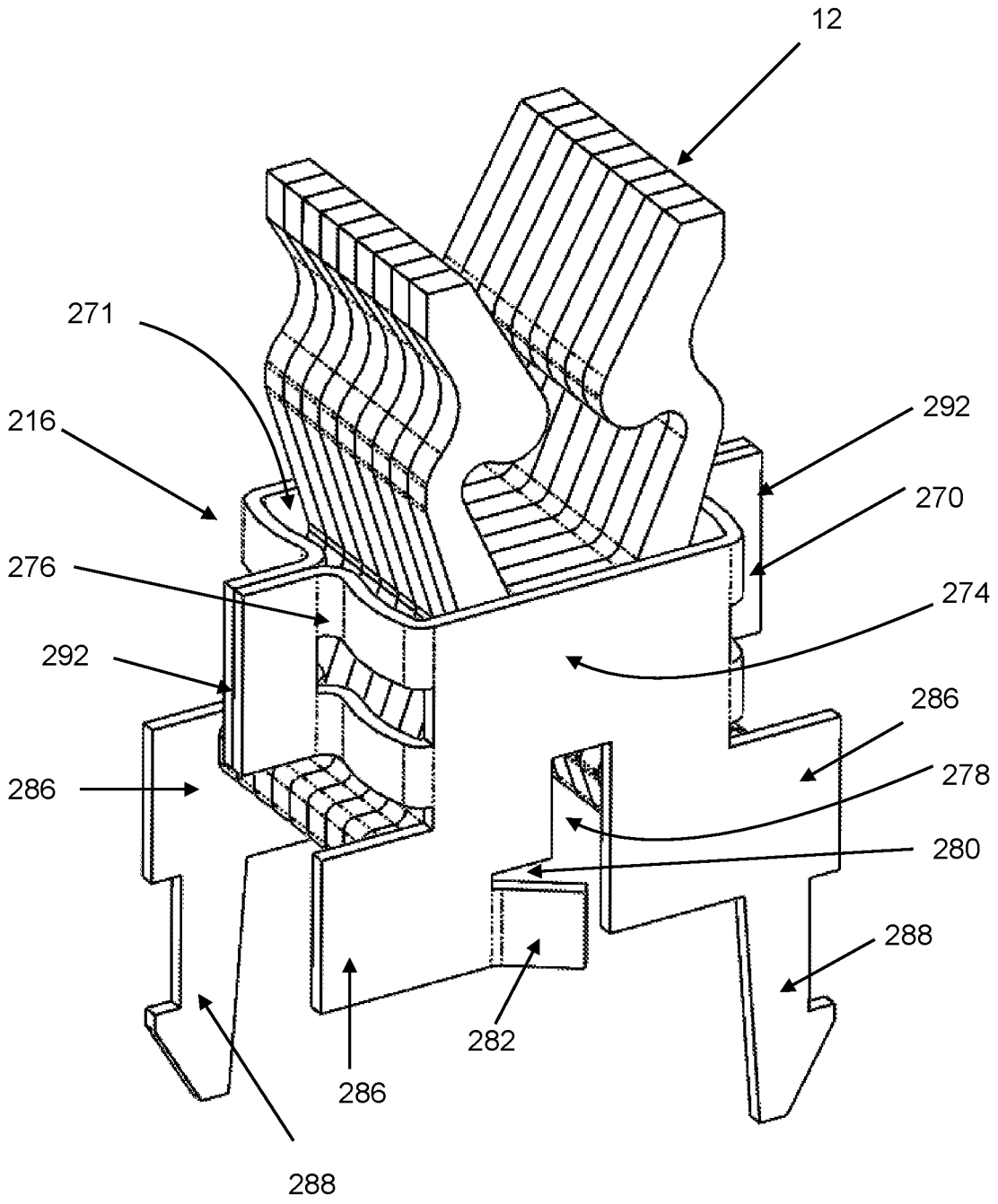
FIG. 14 shows a front perspective view of a coupler of the connector of FIGS. 11 and 12.
Figure 15:
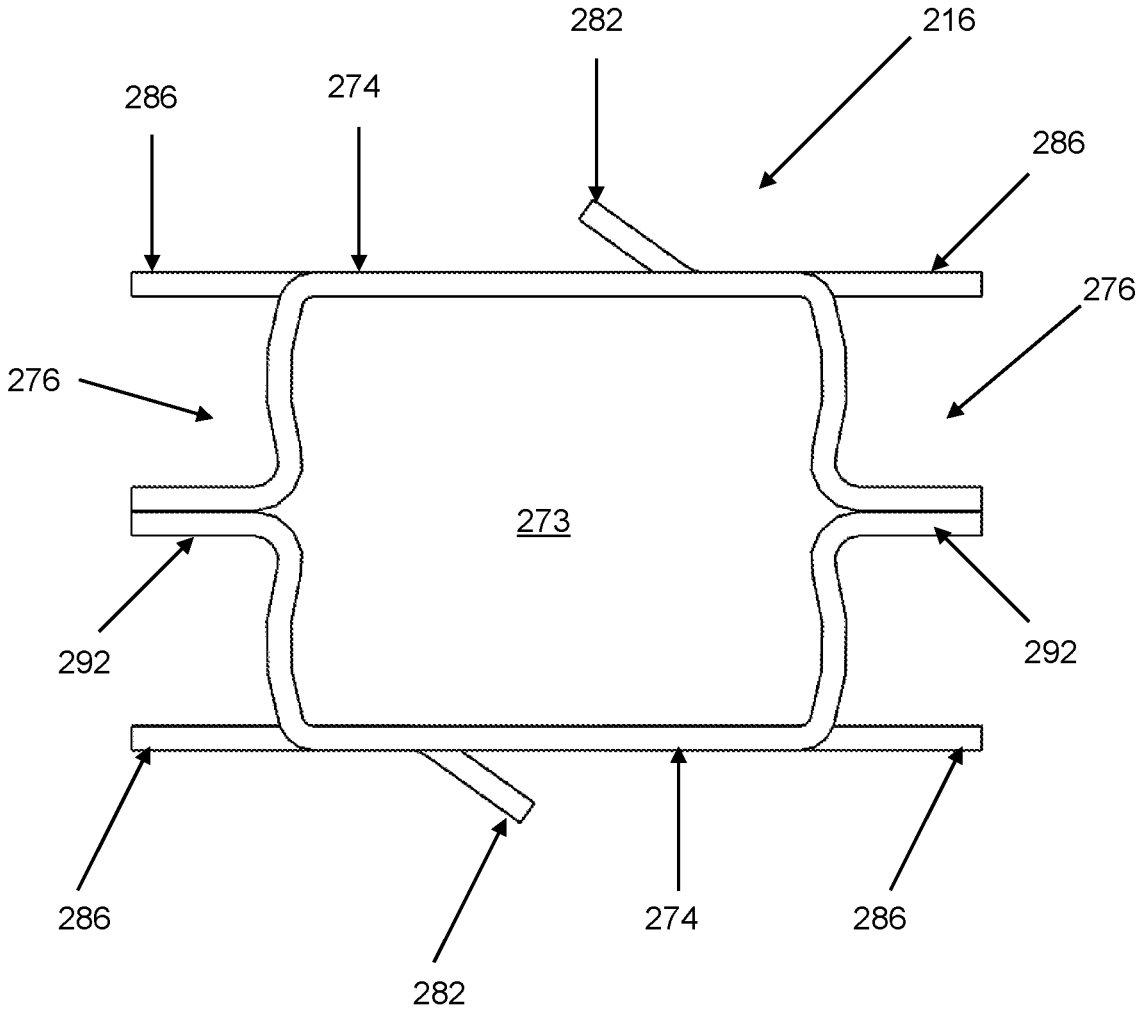
FIG. 15 shows an end view of the housing of the coupler of FIG. 14.

Referring now to FIGS. 12, 14 and 15, the housing 216 includes a main holding section 270 having a top opening 271, a bottom opening 272 and an interior holding space 273 adapted to hold a portion of the stack 12 of contact plates 14. The main holding section 270 is formed by a pair of spaced-apart, opposing side walls 274 connected together by spaced-apart, seamed side structures 276. Vertically-extending slots 278 extend through lower portions of the side walls 274, respectively. The slots 278 are aligned with each other such that a plane extending edgewise through the aligned slots 278 divides the housing 216 into first and second lateral housing portions. Adjoining each slot 278 is a horizontally-extending cut 280, which helps form a tab 282. In each side wall 274, the tab 282 is bent outward so as to be disposed in a different plane than the rest of the side wall 274 (as best shown in FIG. 15). The cuts 280 extend in opposing directions and are disposed in the first and second lateral housing portions, respectively. In this manner, one of the tabs 282 is disposed in the first lateral housing portion and the other one of the tabs 282 is disposed in the second lateral housing portion. In addition, the tabs 282 extend outwardly in opposite directions to each other and are arranged diagonal to each other. In other embodiments, each side wall 274 may have a pair of tabs 282 disposed on opposite sides of the slot 278 and extending in opposite directions to each other.

Each side wall 274 has a pair of opposing, outwardly-extending wing portions 286. With regard to each side wall 274, one of the wing portions 286 is disposed in the first lateral housing portion, while the other one of the wing portions 286 is disposed in the second lateral housing portion, i.e. on opposite sides of the slot 278. A plurality of barbed projections 288 extend downwardly from bottom edges of the wing portions 286. A barbed projection 288 may extend downwardly from each wing portion 286, for a total of four barbed projections 288. Alternately, and as shown, a pair of barbed projections 288 may be provided so as to be arranged diagonal to each other, with one extending downwardly from a wing portion 286 in the first lateral housing portion and the other one extending downwardly from a wing portion 286 in the second lateral housing portion. The barbed projections 288 may extend downwardly from the housing 216 about the same distance as the fastening structures 264. The wing portions 286 position the barbed projections 288 outwardly from the interior holding space 273, which helps stabilize the connection between the stack 12 and a bar-shaped conductor when the connector 200 is mounted to a substrate, as will be described more fully below.

As will be described more fully below, the housing 16 may be formed from two pieces that are joined at seams 292 in the side structures 276, respectively. The housing 216 is especially well-suited for being constructed from metal, such as steel or copper. However, the housing 216 may, alternately, be constructed from plastic. In some embodiments where the housing 216 is constructed from metal, the pieces forming the housing 216 may be at least partially covered with an electrical insulation coating, such as an epoxy resin (e.g. a resin made from epichchlorohydrin and bisphenol A, or epichlorohydrin and an aliphatic polyol, such as glycerol) applied by powder coating.

In order to form the connector 200, the stack 12 of contact plates 14 is mounted to the housing 216 and the mounting contact 215 is mounted to the stack 12. This mounting of components may occur in several different ways. In some embodiments, the mounting contact 215 may first be mounted to the stack 212 to form an intermediary combination to which the housing 216 is then mounted. In other embodiments, the housing 216 may be mounted to the stack 12 first and then the mounting contact 15 may be mounted to the housing 216 and the stack 12. Also, if the housing 216 is formed from multiple pieces, the housing 216 may be formed first and then connected to the other components, or the housing 216 may be formed while it is being connected to the other components.

Referring again to FIGS. 11 and 12, the mounting contact 215 is mounted to the stack 12 of contact plates 14 by aligning the bar 258 with the second receiving groove 44 and then applying a force to bring the mounting contact 215 and the stack 12 together. The blade structure 260 guides the bar 258 into the second receiving groove 44 and the second inner passage 48 of the stack 12. Inside the contact zone 51, the interior edges 23 of the contact plates 14 engage planar surfaces of the bar 258 to make physical and electrical contact therewith.

The contact plates 14 are secured within the housing 216 either in a press-fit operation (when the housing 216 is pre-formed) or in a welding operation when pieces of the housing 216 are secured together around the contact plates 14. If the housing 216 is formed from metal, the welding may be resistance welding, electron beam welding or laser beam welding. If the housing 216 is formed from plastic, the pieces may be joined by ultrasonic welding, adhesive or one or more mechanical connections (not shown). In a press-fit operation, the stack 12 as a whole is pressed into the housing 216, such as through the bottom opening 272. The resulting interference fit between the stack 12 and the housing 216 secures the contact plates 14 within the housing 216, but permits pivoting motion of the contact plates 14, as described below.

When the stack 12 is secured in the housing 216, an upper portion of the stack 12 extends from, and is disposed above, the top opening 271 of the holding section 270. In this regard, at least most of both the first receiving groove 42 and the first inner passage 46 are disposed above the holding section 270 and are accessible from outside the housing 216. A lower portion of the stack 12, including the second receiving groove 44 and the second inner passage 48 are disposed inside the holding section 270. The outer heels of the contact plates 14 extend laterally outward farther than the side structures 276 to help trap the contact plates 14 inside the holding section 270.

The slots 278 in the housing 216 are aligned with the second receiving groove 44 of the stack 12 to form a groove 284 that extends through the connector 200 between the front and rear sides thereof. The bar 258 extends through the groove 284 such that outer end portions of the bar 258 protrude from the side walls 274, respectively, and upper inner edges of the side walls 274 (which help form the slots 278) rest on the bar 258. In addition, outer ones of the fastening structures 264 are mostly disposed outside (and adjacent to) the side walls 274. More specifically, the holes 265 of the outer fastening structures 264 are disposed outside the side walls 274. The tabs 282 are at least partially disposed in the holes 265 of the outer fastening structures 264, respectively, which helps secure together the housing 216 and the mounting contact 215.

Figure 16:
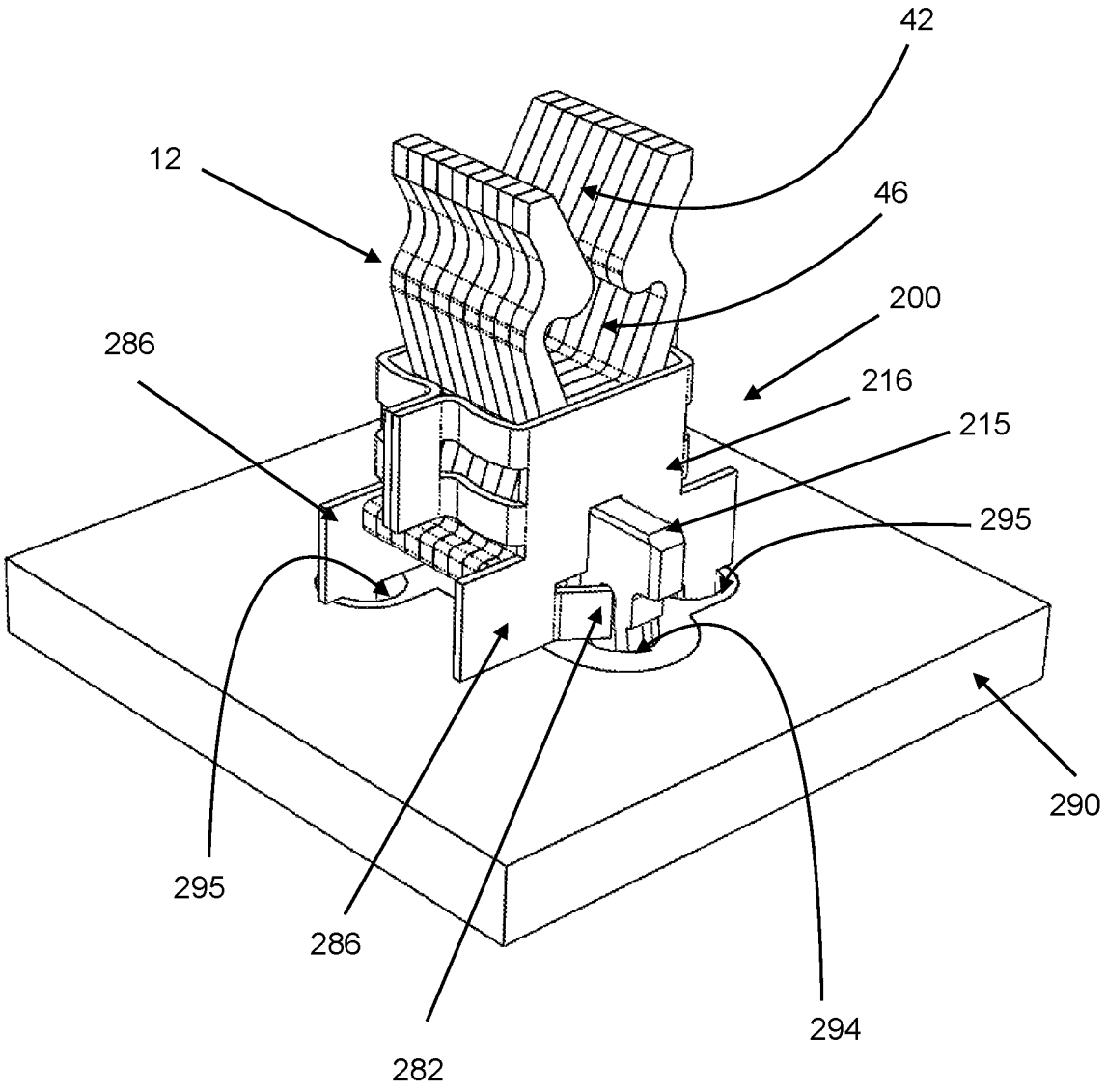
FIG. 16 shows the connector of FIGS. 11 and 12 connected to a printed circuit board.
Figure 17:
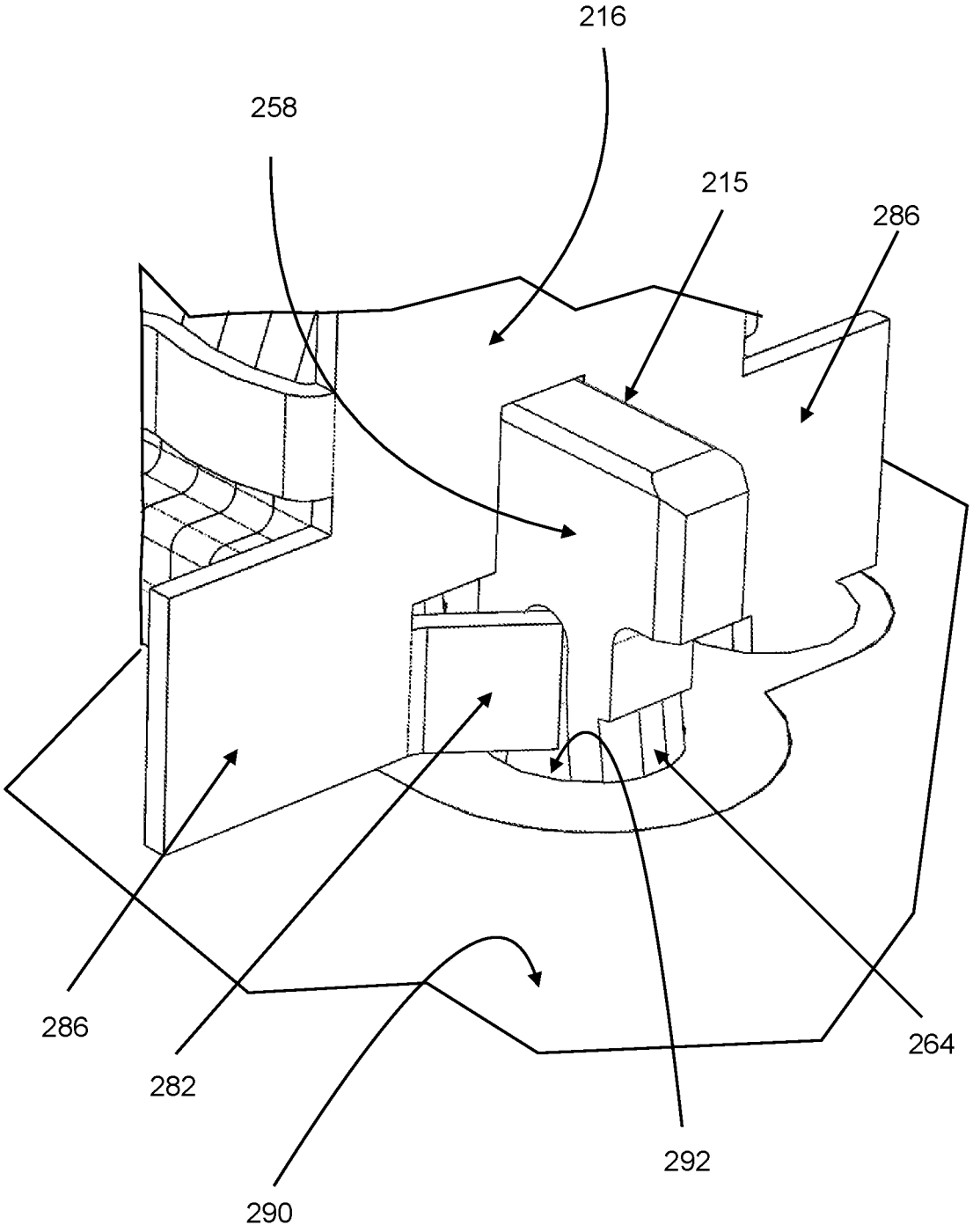
FIG. 17 shows a close-up view of a portion of FIG. 16.

Referring now to FIGS. 16 and 17, the connector 200 is shown mounted to a PCB 290 having a series of plated holes 294 arranged in a line. A pair of mounting openings 295 are also formed in the PCB 290. The mounting openings 295 are arranged diagonal to the line of holes 294. The arrangement of the holes 294 corresponds to the arrangement of the fastening structures 264 in the connector 200 and the arrangement of the mounting openings 295 correspond to the arrangement of the barbed projections 288 in the connector 200. In this manner, the fastening structures 264 may be press-fit into the holes 294, while the barbed projections 288 may be snap-fit into the mounting openings 295. Together, the fastening structures 264 and the barbed projections 288 secure the connector to the PCB 290. The connections between the fastening structures 264 and the plated holes 294 also electrically connect the connector 200 to the PCB 290.

As shown, the wing portions 286 of the connector housing 216 abut a top surface of the PCB 290 and help provide stability against rotating or tipping of the connector 200 relative to the PCB 290 as a result of forces that may be applied by a bar inserted into the first inner passage 46 and/or the first receiving groove 42 of the stack 12 of the connector 200. The stability provided by the wing portions 286 is further enhanced by the barbed projections 288 of the wing portions 286 being secured in the mounting openings 295 of the PCB 290. As best shown in FIG. 17, the tabs 282 of the housing 216 are trapped in the holes 265 of the outer fastening structures 264, respectively, which are, in turn, secured within the holes 294 of the PCB 290. In this manner, the interconnection between the tabs 282 and the fastening structures 264 helps secure the housing 216 to the PCB 290 and provides further stability.

Referring now to FIGS. 18-21, a method of forming connectors 200 will be described.

Figure 18:
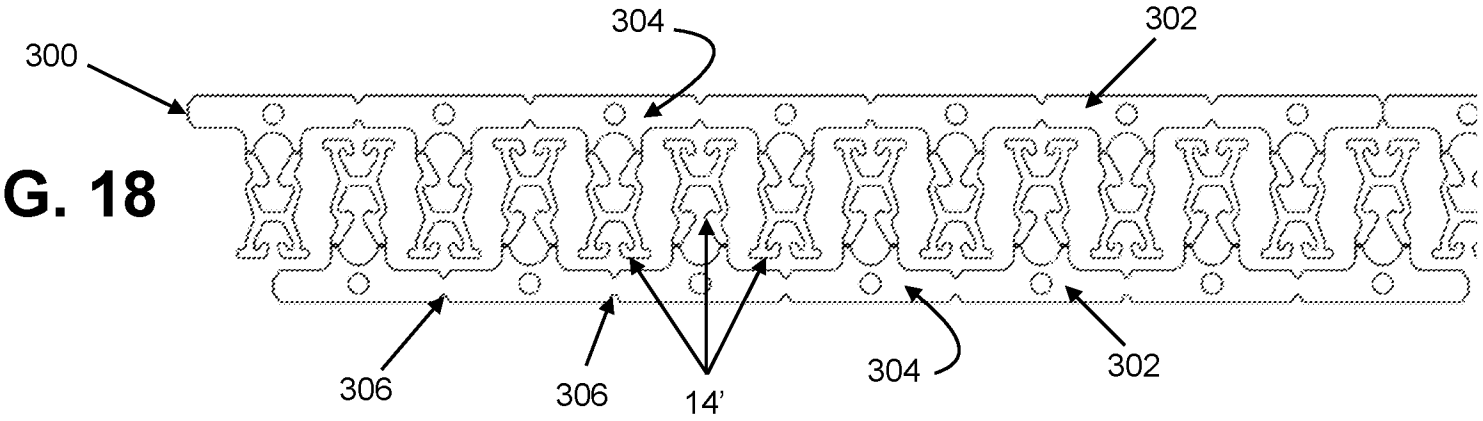
FIG. 18 shows a plan view of a metal strip stamped to form a plurality of nascent contact plates for connectors of the type shown in FIGS. 11 and 12.

A plurality of contact plates 14 may be stamped from an elongated strip 300 of metal, as is shown in FIG. 18. The strip 300 may be stamped so as to form two pieces 302, each of which includes a plurality of nascent contact plates 14' secured at their first end portions 26 to a narrow header ribbon 304. In each piece 302, the nascent contact plates 14' are separated by pairs of opposing notches 306.

Figure 19:
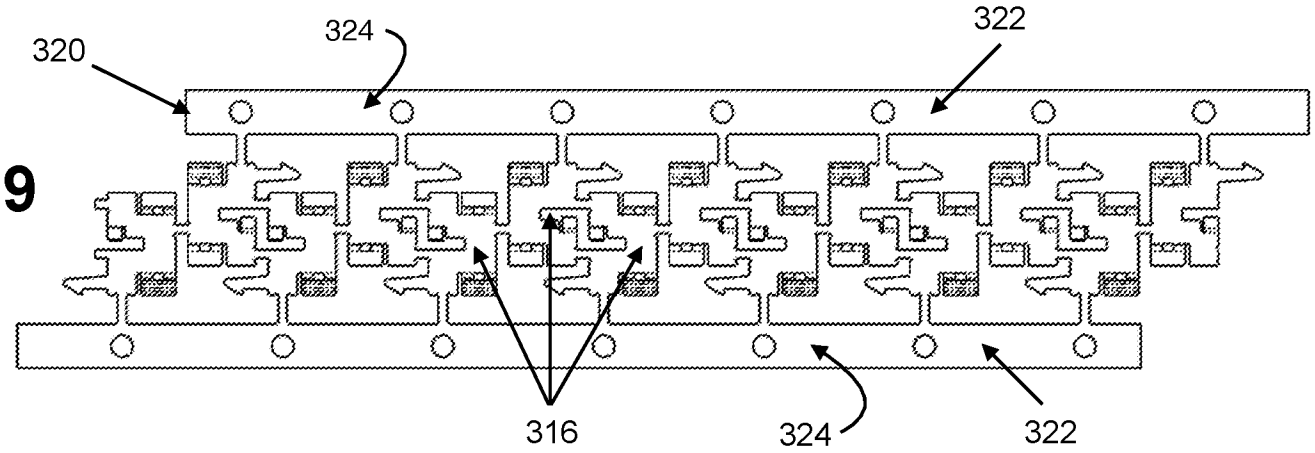
FIG. 19 shows a plan view of a metal strip stamped to form a plurality of housing sections for connectors of the type of of FIGS. 11 and 12.

A plurality of housing sections 316 may be stamped from an elongated strip 320 of metal, as is shown in FIG. 19. In some embodiments, the strip 320 may be coated on both sides with an electrical insulation coating. The strip 320 may be stamped so as to form two pieces 322, each of which includes a plurality of the housing sections 316 secured to a narrow header ribbon 324. Each housing section 316 is connected to the header ribbon 324 by a tab connected to one of the wing portions 286. In the manufacturing process described below, one of the pieces 322 is flipped end over end so that its top surface becomes its bottom surface, but its housing sections 316 still extend from the header ribbon 324 in the same direction. This flipped piece 322 is then shifted and overlaid the other piece 322 such that the housing sections 316 of the two pieces 322 are aligned and overlay each other to form a plurality of nascent housings 216' in a strip assembly 326 (shown in FIG. 21).

Figure 20:
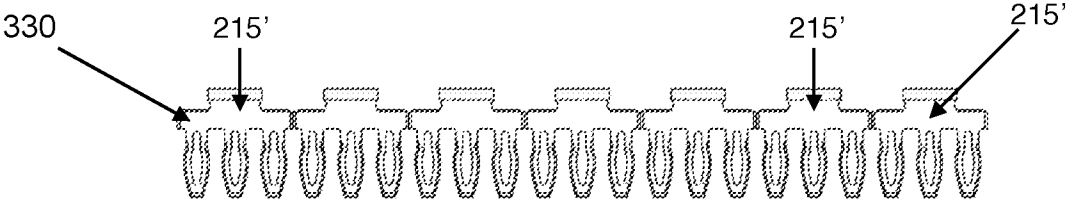
FIG. 20 shows a plan view of a metal strip stamped to form a plurality of nascent mounting contacts for connectors of the type of FIGS. 11 and 12.

As shown in FIG. 20, a plurality of mounting contacts 215 may be stamped from an elongated strip of metal to produce a stamped strip 330 comprising a plurality of nascent mounting contacts 215' secured together at the ends of their bars 258 by scored connections.

Figure 21:
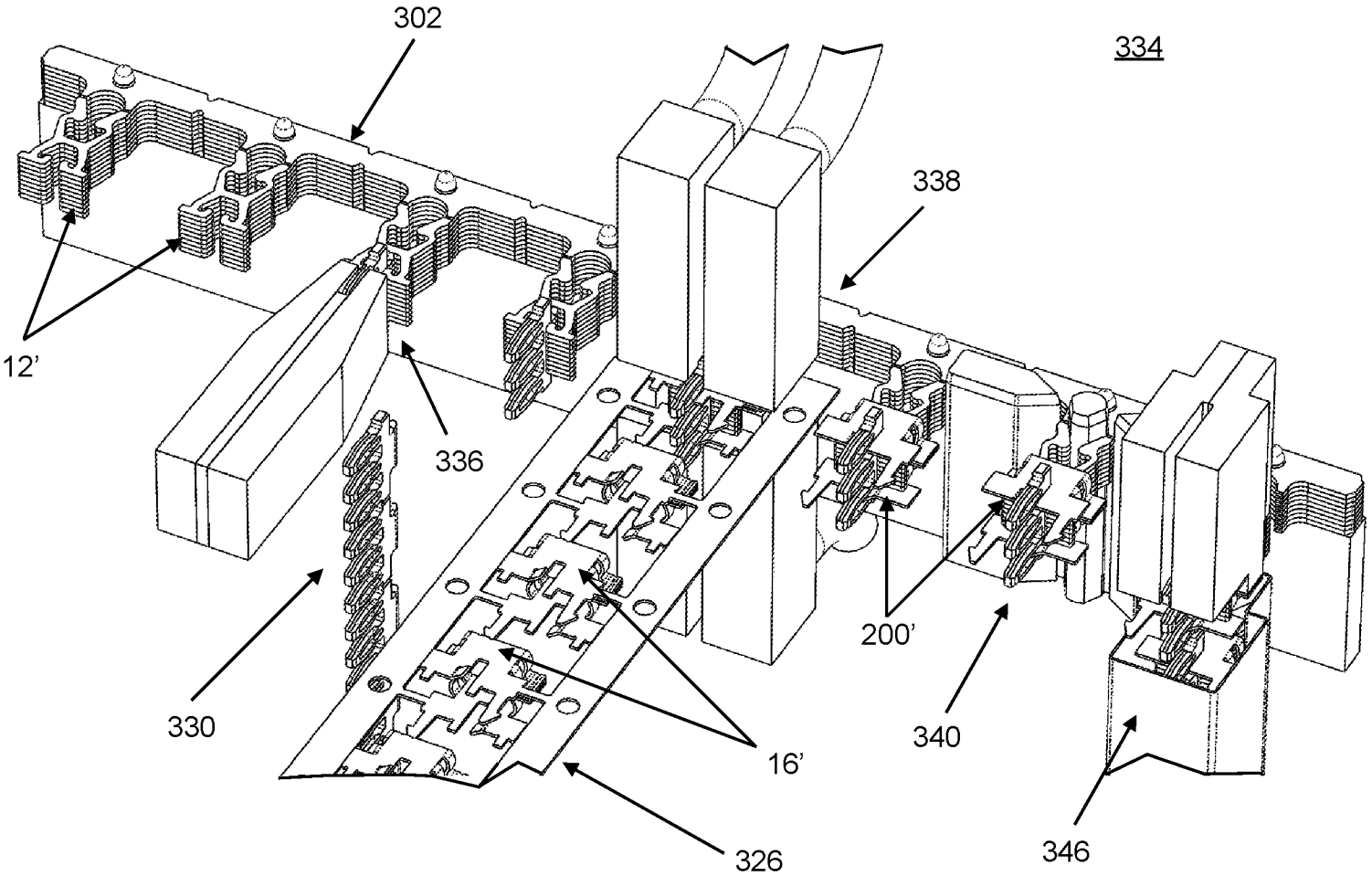
FIG. 21 shows a manufacturing line for producing connectors of the type of FIGS. 11 and 12.

Referring now to FIG. 21, connectors 200 are shown being produced in a manufacturing line 334 from pieces 302 of nascent contact plates 14', stamped strips 330 of nascent mounting contacts 215' and pieces 322 of nascent housings 216'. The pieces 302 are stacked together to form nascent stacks 12' of nascent contact plates 14'. The stack of pieces 302 are moved down the manufacturing line 334 through stations 336, 338 and 340 in an indexed manner using the notches 306.

At a station 336, a nascent mounting contact 215' from the stamped strip 330 is inserted into the second receiving groove 44 and the second inner passage 48 of a nascent stack 12' and then a scored connection connecting the nascent mounting contact 215' is cut to separate it from the rest of the stamped strip 330. The nascent stack 12' with the mounting contact 215' attached thereto is then moved to the station 338 where it is engaged with the strip assembly 326.

At the station 338, the strip assembly 326 is moved such that the nascent stack 12' with the mounting contact 215' attached thereto is disposed between two housing sections 316 forming a nascent housing 16'. The portions of the two housing sections 316 forming the side structures 276 are then welded together, which forms the housing 216 and separates it from the strip assembly 326. The nascent stack 12' and the attached mounting contact 215' are now secured within the housing 216 to form a nascent connector 200', which is moved to station 340.

At the station 340, pinchers separate the nascent connector 200' from the stack of pieces 302 by cutting the connections between the first end portions 26 of the nascent contact plates 14' and the narrow header ribbons 304 in the stack of pieces 302. The separated connector 200 is then loaded into a tube 346 for storage and/or shipping.

It is to be understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. A connector for connection to a substrate for mounting electronic devices, the substrate having one or more holes formed therein, the connector comprising:

a housing;

a plurality of monolithic metal contact plates held by the housing so as to be pivotably movable, each of the contact plates having opposing planar surfaces and comprising a pair of elements having opposing first and second end portions, respectively, the elements being joined together, intermediate the first and second end portions, with the first end portions being separated by a first space and the second end portions being separated by a second space, the contact plates being aligned and arranged serially in the housing with the planar surfaces of the contact plates being disposed parallel to each other; and at least one mounting contact extending into the housing and having a bar section with opposing first and second edge portions, the bar section being disposed in the second space of at least one of the contact plates such that the first edge portion is disposed toward where the elements are joined together, the mounting contact further having a fastening structure joined to and extending from the second edge portion of the bar section, the fastening structure being adapted for insertion into one of the holes of the substrate.

2. The connector of claim 1, wherein the contact plates are separated from each other.

3. The connector of claim 2, wherein the contact plates are separated from each other by portions of the housing.

4. The connector of claim 3, wherein the housing has one or more first end openings and one or more opposing second end openings, and wherein the first spaces of the contact plates are disposed toward the one or more first end openings of the housing and the second spaces of the contact plates are disposed toward the one or more second end openings of the housing.

5. The connector of claim 4, wherein the housing has a plurality of the first and second end openings, and wherein the housing comprises a plurality of pockets arranged serially along its length, the pockets each having one of the first end openings and one of the second end openings; and wherein the contact plates are disposed in the pockets, respectively.

6. The connector of claim 5, wherein the at least one mounting contact comprises a plurality of the mounting contacts, the bar sections of the mounting contacts being disposed in the second spaces of the contact plates, respectively.

7. The connector of claim 6, wherein each of the fastening structures is configured for press-fit insertion into one of the holes in the substrate and comprises a pair of resiliently movable beams separated by a piercing.

8. The connector of claim 2, wherein the contact plates are separated from each other by insulation coatings on the contact plates, respectively.

9. The connector of claim 1, wherein the contact plates are arranged in a stack in the housing such that the first spaces of the contact plates are aligned to form a first receiving groove in the stack and the second spaces of the contact plates are aligned to form a second receiving groove in the stack, the first and second receiving grooves being oppositely directed.

10. The connector of claim 9, wherein at least one of the planar surfaces of each contact plate adjoins the planar surface of an adjacent contact plate.

11. The connector of claim 9, wherein the at least one mounting contact is a single mounting contact;

wherein the bar section of the mounting contact is disposed in the second receiving groove of the stack; and wherein the fastening structure is configured for press-fit insertion into one of the holes in the substrate and comprises a pair of resiliently movable beams separated by a piercing.

12. The connector of claim 11, wherein the housing comprises a pair of opposing side walls connected together by a pair of spaced-apart side structures to thereby define an interior holding space within which at least portions of the contact plates are disposed, the side walls having slots formed therein, respectively, the slots being aligned with each other and with the second receiving groove of the stack of the contact plates; and wherein the bar section of the mounting contacts extends through the aligned slots in the side walls of the housing.

13. The connector of claim 12, wherein each of the side walls includes wing portions disposed on opposing sides of the slot, respectively, the wing portions extending laterally outward beyond the interior holding space.

14. The connector of claim 13, wherein the housing comprises a plurality of housing sections that are secured together.

15. The connector of claim 14, wherein the housing sections are metal and are joined together by welding.

16. The connector of claim 15, wherein the housing sections are coated with an electrical insulation coating.

17. The connector of claim 13, wherein the housing further comprises a plurality of snap-fit projections joined to a plurality of the wing portions, respectively, and extending away therefrom.

18. The connector of claim 17, wherein each of the snap-fit projections extends in the same direction as the fastening structure and is adapted for securement within one of the holes in the substrate.

19. A method of forming a plurality of connectors, the method comprising:

providing one or more first strips of metal;

providing one or more second strips of metal;

stamping the one or more first strips of metal to form a plurality of separate contact plates strips, each of which comprises interconnected nascent contact plates, each of the nascent contact plates comprising a pair of elements having opposing first and second end portions, respectively, the elements being joined together, intermediate the first and second end portions, with the first end portions being separated by a first space and the second end portions being separated by a second space; wherein each of the contact plate strips comprises a header ribbon to which the first end portions of the nascent contact plates are joined;

stamping the one or more second strips of metal to form a plurality of separate housing strips, each of which comprises a plurality of housing sections joined to a header ribbon;

manipulating the contact plate strips to form a stack of the contact plate strips, each of which comprises a plurality of stacks of the nascent contact plates;

manipulating the housing strips to have one of the housing strips overlay another one of the housing strips to form a combination of the housing strips that comprises a plurality of interconnected nascent housings, each of the nascent housings comprising a pair of adjacent housing sections;

inserting a first one of the stacks of the nascent contact plates into a first one of the nascent housings;

welding together the housing sections of the first one of the nascent housings;

separating the first one of the nascent housings from the combination of the housing strips; and separating the first one of the stacks of the nascent contact plates from the stack of the contact plate strips.

20. The method of claim 19, wherein the step of separating the first one of the stacks of the nascent contact plates occurs after the step of welding together the housing sections of the first one of the nascent housings.

* * * * *